US009220160B2

(12) United States Patent
Nishikawa et al.

(10) Patent No.: US 9,220,160 B2
(45) Date of Patent: Dec. 22, 2015

(54) DISCHARGE LAMP LIGHTING DEVICE AND HEADLIGHT USING SAME

(71) Applicant: Panasonic Intellectual Property Management Co., Ltd., Osaka (JP)

(72) Inventors: Masahiro Nishikawa, Osaka (JP); Masatoshi Ueno, Osaka (JP); Kazuya Kato, Osaka (JP); Masashi Kichima, Niigata (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/646,581

(22) PCT Filed: Oct. 17, 2013

(86) PCT No.: PCT/JP2013/006153

§ 371 (c)(1),
(2) Date: May 21, 2015

(87) PCT Pub. No.: WO2014/083753

PCT Pub. Date: Jun. 5, 2014

(65) Prior Publication Data

US 2015/0305129 A1 Oct. 22, 2015

(30) Foreign Application Priority Data

Nov. 28, 2012 (JP) ..... 2012-260027

(51) Int. Cl.
*H05B 37/02* (2006.01)
*H05B 41/24* (2006.01)
(Continued)

(52) U.S. Cl.
CPC ..... *H05B 41/2926* (2013.01); *H05B 41/2886* (2013.01); *H05B 41/2887* (2013.01)

(58) Field of Classification Search
CPC ..... H05B 41/24; H05B 41/36; H05B 37/02
USPC ..... 315/82, 77, 268, 276, 287, 226, 209 R
See application file for complete search history.

(56) References Cited

U.S. PATENT DOCUMENTS 7,208,882 B2 * 4/2007 Ishizuka ..... H05B 41/2886 315/225
2012/0217873 A1 * 8/2012 Tanaka ..... H05B 33/0815 315/82

FOREIGN PATENT DOCUMENTS

JP 10-312895 A 11/1998
JP 2008-135229 A 6/2008
(Continued)

OTHER PUBLICATIONS

International Search Report for corresponding International Application No. PCT/JP2013/006153 mailed Jan. 21, 2014.
(Continued)

*Primary Examiner* — Daniel D Chang
(74) *Attorney, Agent, or Firm* — Renner, Otto, Boisselle & Sklar, LLP

(57) ABSTRACT

Control unit decreases power to be supplied to high-pressure discharge lamp when an output voltage or an output current for high-pressure discharge lamp measured by measurement unit is in an abnormal range. Drive unit driving switching element includes capacitor that supplies, to a control electrode of switching element disposed on high potential side, electric charge necessary for turning on switching element disposed on high potential side when switching element disposed on low potential side is turned off. When high-pressure discharge lamp is started up, a discharge lamp lighting device starts to charge capacitor before DC/DC converter is started to operate, and control unit has a determination period for determining presence/absence of an abnormality based on a measured value acquired by measurement unit in a state in which DC/DC converter and DC/AC inverter are operated after completion of charging of capacitor.

14 Claims, 14 Drawing Sheets

(51) Int. Cl.

| | |
|---|---|
| ***H05B 41/36*** | (2006.01) |
| ***H05B 41/292*** | (2006.01) |
| ***H05B 41/288*** | (2006.01) |

(56) References Cited

FOREIGN PATENT DOCUMENTS

| | | | |
|---|---|---|---|
| JP | 2010-135195 | A | 6/2010 |
| JP | 2010-211949 | A | 9/2010 |
| JP | 2010-277965 | A | 12/2010 |
| JP | 2010-277966 | A | 12/2010 |
| JP | 2011-014425 | A | 1/2011 |

OTHER PUBLICATIONS

Form PCT/ISA/237 for corresponding International Application No. PCT/JP2013/006153 dated Jan. 21, 2014.

* cited by examiner

DISCHARGE LAMP LIGHTING DEVICE AND HEADLIGHT USING SAME

TECHNICAL FIELD

The present invention relates to a discharge lamp lighting device and a headlight using the discharge lamp lighting device.

BACKGROUND ART

Conventionally, high-pressure discharge lamp lighting devices used for lighting high-pressure discharge lamps have been proposed (for example, see JP 2010-135195 A (hereinafter, referred to as "Literature 1")). In the high-pressure discharge lamp lighting device disclosed in Literature 1, a full bridge circuit converts a DC output of a step-down chopper circuit into an AC current having a rectangular wave and supplies the AC current to a lamp (high-pressure discharge lamp).

In this high-pressure discharge lamp lighting device, by applying a high-voltage pulse to a lamp using an igniter circuit at a startup time, insulation breakdown of the lamp is caused, and glow discharge occurs. Thereafter, the lamp transits to arc discharge from the glow discharge, so that light fluxes rise.

The full-bridge circuit is configured by connecting first and second arms each formed by a series circuit of two transistors in parallel with each other, a set of transistors that are diagonally located are caused to be simultaneously in the On state, and On/Off of each set is alternately switched. Here, out of the transistors configuring each arm, a high potential-side transistor is caused to be in the On state when a low potential-side transistor is in the Off state. Thus, in order to cause the high potential-side transistor to be in the On state, a bootstrap capacitor supplying electric charge to a gate electrode of the transistor is arranged.

Here, in an unloaded condition before the startup of the discharge lamp, it may be considered to perform a startup operation in a speedy manner by shortening a time required for raising the output voltage of the step-down chopper circuit up to a predetermined voltage by operating the step-down chopper circuit during the process of charging the bootstrap capacitor. However, in a case where the full bridge circuit is operated in a state in which the output voltage of the step-down chopper circuit is raised by operating the step-down chopper circuit during the process of charging the bootstrap capacitor, when the load forms a short circuit, there is a problem in that an overcurrent flows in the circuit.

In addition, in the high-pressure discharge lamp lighting device disclosed in Literature 1, in a case where the step-down chopper circuit is a non-insulation type, when the load forms a short circuit at the start-up time, energy input from the power supply side is delivered to the output side even in a case where the step-down chopper circuit is stopped, and there is a problem in that an overcurrent flows in the circuit.

DISCLOSURE OF THE INVENTION

The present invention has been made in view of such a problem, and an object thereof is to provide a discharge lamp lighting device and a headlight using the discharge lamp lighting device, configured to make it difficult for an overcurrent to flow in the circuit when an abnormality such as formation of a short circuit occurs.

A discharge lamp lighting device according to the present invention includes a DC/DC converter, a DC/AC inverter, a drive unit, a measurement unit, and a control unit. The DC/DC converter is configured to convert an input voltage input from a DC power supply into a voltage value that is necessary for lighting a discharge lamp by performing switching. The DC/AC inverter is configured by a bridge circuit in which at least one series circuit of a first switching element disposed on a high potential side and a second switching element disposed on a low potential side is connected between output terminals of the DC/DC converter, and is configured to convert a DC output of the DC/DC converter into an AC output and supply the AC output to a load including the discharge lamp. The drive unit converts the DC output of the DC/DC converter into an AC output acquired by alternating polarity of the DC output at a predetermined period by alternately turning on the first switching element and the second switching element at the predetermined period at least at a time of stable lighting. The measurement unit measures at least one of an output voltage and an output current for the load. When a measured value acquired by the measurement unit is in an abnormal range, the control unit is configured to decrease power to be supplied to the discharge lamp to be lower than power to be supplied to the discharge lamp at a normal time. The drive unit includes a capacitor that supplies, to a control electrode of the first switching element disposed on the high potential side, electric charge necessary for turning on the first switching element when the second switching element disposed on the low potential side is turned off. The capacitor is charged when the second switching element is turned on. When the discharge lamp is started up, the capacitor is started to be charged before the DC/DC converter starts to be operated, and the DC/DC converter and the DC/AC inverter are operated after completion of the charging of the capacitor. The control unit has a determination period for determining presence/absence of an abnormality based on the measured value acquired by the measurement unit in this state.

In this discharge lamp lighting device, it is preferable that, when the measured value acquired by the measurement unit is in the abnormal range during the determination period, the control unit is configured to stop a switching operation of the DC/DC converter.

In addition, in this discharge lamp lighting device, it is preferable that the control unit is configured to detect formation of a short circuit in the load as the abnormality based on the measured value acquired by the measurement unit during the determination period.

In addition, in this discharge lamp lighting device, it is preferable that the drive unit is configured to charge the capacitor again in a case where the control unit determines that no abnormality is present during the determination period.

In addition, in this discharge lamp lighting device, it is preferable that the measurement unit is configured to measure an output current of the DC/DC converter during the determination period, and the control unit is configured to determine that formation of a short circuit has occurred in the load when a current value measured by the measurement unit is a predetermined threshold current or more.

In addition, in this discharge lamp lighting device, it is preferable that the measurement unit is configured to measure an output voltage of the DC/DC converter during the determination period, and the control unit is configured to determine that formation of a short circuit has occurred in the load when a voltage value measured by the measurement unit is a predetermined threshold voltage or less.

In addition, in this discharge lamp lighting device, it is preferable that the measurement unit is configured to measure both an output current and an output voltage of the DC/DC converter during the determination period, and the control unit is configured to determine that formation of a short circuit has occurred in the load when the current value measured by the measurement unit is a predetermined threshold current or more, and the voltage value measured by the measurement unit is a predetermined threshold voltage or less.

In addition, in this discharge lamp lighting device, it is preferable that, when determining that the abnormality has occurred during the determination period, the control unit is configured to turn off the first switching element disposed on the high potential side within a predetermined time.

In addition, in this discharge lamp lighting device, it is preferable that the DC/DC converter is of a non-insulating type.

A headlight according to the present invention includes one of the discharge lamp lighting devices described above.

According to the present invention, a discharge lamp lighting device suppressing the flow of an overcurrent in the circuit at the time of the occurrence of an abnormality such as formation of a short circuit can be realized.

In addition, a headlight suppressing the flow of an overcurrent in the circuit of a discharge lamp lighting device at the time of the occurrence of an abnormality such as formation of a short circuit can be realized.

EMBODIMENT FOR CARRYING OUT THE INVENTION

Hereinafter, embodiments in which a discharge lamp lighting device according to the present invention is applied to a lighting device for a high-pressure discharge lamp will be described with reference to the drawings. As examples of the high-pressure discharge lamp, there are a metal halide lamp, a high-pressure sodium lamp, and the like. Compared to an incandescent lamp, such high-pressure discharge lamps have a high luminance level and a long life and are also used as headlights of vehicles.

(Embodiment 1)

Figure 1:
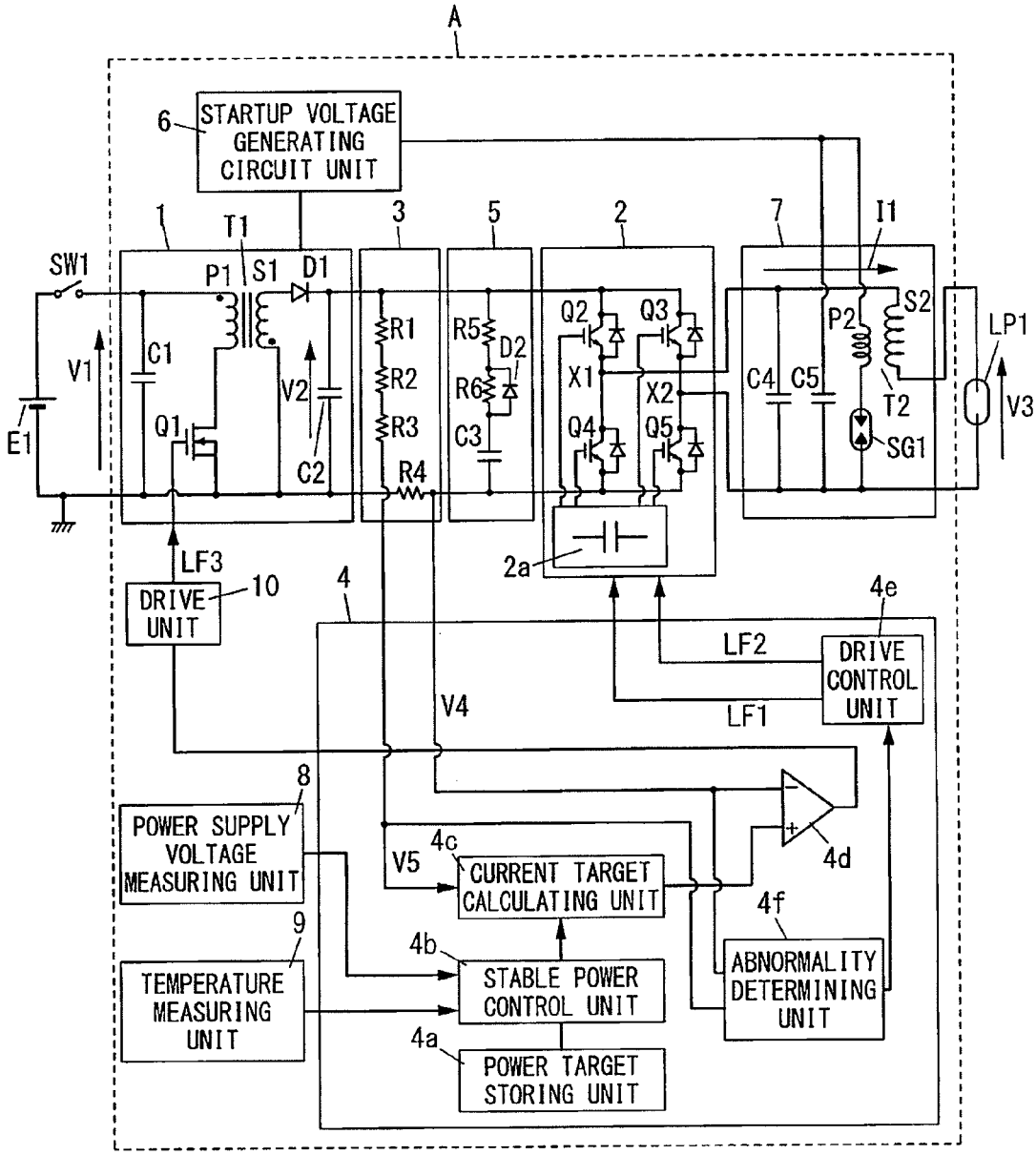
FIG. 1 is a circuit diagram of a discharge lamp lighting device according to Embodiment 1.

FIG. 1 illustrates a circuit diagram of a discharge lamp lighting device A according to this embodiment. This discharge lamp lighting device A includes a DC/DC converter 1, a DC/AC inverter 2, a measurement unit 3, a control unit 4, a startup auxiliary circuit unit 5, a startup voltage generating circuit unit 6, an igniter unit 7, a power supply voltage measuring unit 8, a temperature measuring unit 9, and a drive unit 10.

The DC/DC converter 1 is configured by a fly-back type converter circuit that boosts a power supply voltage of a DC power supply E1 to a desired voltage value. The DC/DC converter 1 includes: a transformer T1, a switching element Q1 configured by a field effect transistor, a diode D1, and capacitors C1 and C2. The capacitor C1 is connected across the DC power supply El through a power supply switch SW1. Across the capacitor C1, a series circuit of a primary winding P1 of the transformer T1 and the switching element Q1 is connected. One end side of a secondary winding S1 of the transformer T1 is connected to the negative electrode side of the DC power supply E1, and the capacitor C2 is connected across the secondary winding S1 through the diode D1. Here, the winding directions of the primary winding P1 and the secondary winding S1 of the transformer T1 are opposite to each other.

The DC/AC inverter 2 includes switching elements Q2 to Q5 each configured by a field effect transistor (FET) and a drive circuit (drive unit) 2*a*. The DC/AC inverter 2 is configured to convert a DC voltage output from the DC/DC converter 1 into a low-frequency rectangular wave AC voltage and supplies the AC voltage to a load 11 (see FIG. 2) including a high-pressure discharge lamp LP1. A first arm that is configured by a series circuit of the switching elements Q2 and Q4 and a second arm that is configured by a series circuit of the switching elements Q3 and Q5 are connected between output terminals of the DC/DC converter 1. Between a connection point X1 of the switching elements Q2 and Q4 configuring the first arm and a connection point X2 of the switching elements Q3 and Q5 configuring the second arm, the high-pressure discharge lamp LP1 that is a load is connected through the igniter unit 7. Here, the switching elements Q2 to Q5 configuring the DC/AC inverter 2 are not limited to FETs but, for example, may be switching elements such as bipolar transistors or IGBTs.

The measurement unit 3 is configured to measure an output voltage V3 and an output current I1 for the high-pressure discharge lamp LP1 that is the load. In this embodiment, the measurement unit 3, in order to measure the output voltage V3, includes a series circuit of resistors R1, R2, and R3 connected to the high-potential side output terminal of the DC/DC converter 1 and measures a voltage V5 that is proportional to the output voltage V3. In addition, the measurement unit 3, in order to measure the output current I1, includes a resistor R4 used for current detection, which is connected between the DC/DC converter 1 and the DC/AC inverter 2, and measures a voltage V4 generated across the resistor R4 according to the flow of the output current I1 in the resistor R4.

The startup auxiliary circuit unit 5 includes a series circuit of resistors R5 and R6 and a capacitor C3 connected between the output terminals of the DC/DC converter 1, and a diode D2 connected to the resistor R6 in parallel therewith. The anode of the diode D2 is connected to the capacitor C3, and the cathode of the diode D2 is connected to the resistor R5. At the unloaded time before the startup of the high-pressure discharge lamp LP1, the capacitor C3 is charged according to the output voltage of the DC/DC converter 1. Then, immediately after the high-pressure discharge lamp LP1 is lighted, during a period in which the DC/DC converter 1 cannot be operated, in order not to cause the high-pressure discharge lamp LP1 to fade away, electric charge charged in the capacitor C3 is supplied to the high-pressure discharge lamp LP1 through the diode D2 and the resistor R5.

The startup voltage generating circuit unit 6 is a circuit that generates a high voltage causing a discharge gap SG1 of the igniter unit 7, which will be described later, to be broken down and, for example, is a multi-stage voltage boosting circuit configured by a capacitor and a diode, a voltage boosting circuit that boosts a voltage according to a winding ratio of a transformer, or the like.

The igniter unit 7 includes a voltage boosting transformer T2, a discharge gap SG1, and capacitors C4 and C5. The capacitor C4 is connected between the connection point X1 and the connection point X2, and the capacitor C5 is connected between the output terminal of the startup voltage generating circuit unit 6 and the connection point X2. In addition, a series circuit of the secondary winding S2 of the voltage boosting transformer T2 and the high-pressure discharge lamp LP1 is connected between the connection point X1 and the connection point X2, and a series circuit of the primary winding P2 of the voltage boosting transformer T2 and the discharge gap SG1 is connected between the output terminal of the startup voltage generating circuit unit 6 and the connection point X2. At the time of a startup/lighting operation, a high voltage is applied from the startup voltage generating circuit unit 6 to the discharge gap SG1, and, when the discharge gap SG1 is broken down, a high-pressure pulse of about several tens of kV boosted according to the winding ratio is applied to the high-pressure discharge lamp LP1 through the secondary winding S2.

The control unit 4 includes a power target storing unit 4*a*, a stable power limiting unit (stable power control unit) 4*b*, a current target calculating unit 4*c*, an error amplifier 4*d*, a drive control unit 4*e*, and an abnormality determining unit 4*f*, and is configured to control On/Off of the switching elements Q1 to Q5.

In the power target storing unit 4*a*, a target value of power output from the DC/DC converter 1 is stored in advance. The stable power limiting unit 4*b* corrects the target value of the power that is stored in the power target storing unit 4*a* based on a temperature measured by the temperature measuring unit 9 or a power supply voltage of the DC power supply E1 that is measured by the power supply voltage measuring unit 8 and outputs a target value after the correction to the current target calculating unit 4*c*. The current target calculating unit 4*c* acquires a target value of the output current I1 by dividing the target value of the power that is input from the stable power limiting unit 4*b* by an output voltage acquired based on the voltage V5 measured by the measurement unit 3. The error amplifier 4*d* compares the target value of the output current I1 that is acquired by the current target calculating unit 4*c* with the output current I1 acquired based on the voltage V4 measured by the measurement unit 3, and outputs a signal acquired by amplifying an error therebetween to the drive unit 10. The drive unit 10, according to the signal input from the error amplifier 4*d*, controls the duty ratio of a signal LF3 to be applied to the gate electrode of the switching element Q1 such that the measured value of the output current I1 coincides with the target value.

Figure 2:
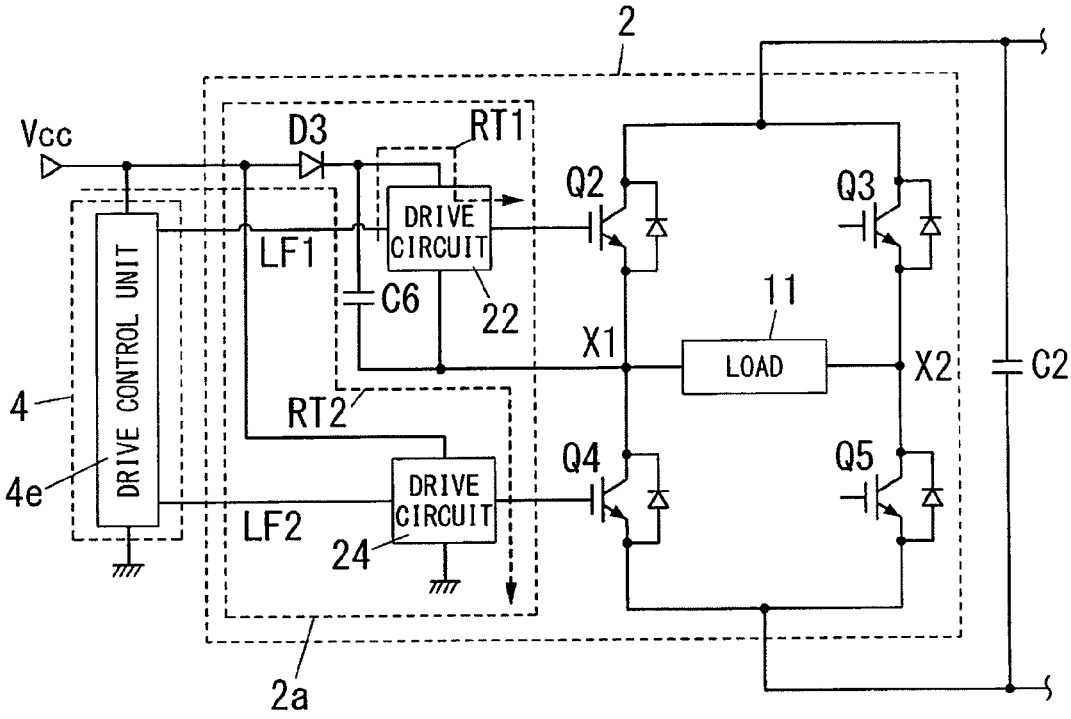
FIG. 2 is a circuit diagram that illustrates a main portion of the discharge lamp lighting device according to Embodiment 1.

By controlling the operation of the drive circuit 2*a*, the drive control unit 4*e* performs switching of the four switching elements Q2 to Q5 included in the DC/AC inverter 2 between On/Off. Here, the On/Off operations of the switching elements Q2 to Q5 will be described in more detail with reference to a circuit diagram of FIG. 2. FIG. 2 illustrates details of a circuit portion that drives the switching elements Q2 and Q4 configuring the first arm, and the other circuit configurations are not illustrated therein.

Between the connection point X1 of the switching elements Q2 and Q4 and the connection point X2 of the switching elements Q3 and Q5, the load 11 including the high-pressure discharge lamp LP1 is connected.

The drive circuit 2*a* includes a drive circuit 22 that is connected between the gate and the source of the high-potential side switching element (first switching element) Q2, and a drive circuit 24 that is connected between the gate and the source of the low-potential side switching element (second switching element) Q4. The drive circuit 24 driving the second switching element Q4 disposed on the low potential side receives an operation voltage Vcc from a drive power supply (not illustrated in the figure) that receives the supply of power from the DC power supply E1 and generates operation power of the control unit 4 and the like. On the other hand, the drive circuit 22 driving the first switching element Q2 disposed on the high potential side, in order to cause the first switching element Q2 to become On in the Off state of the second switching element Q4 disposed on the low potential side, causes the first switching element Q2 to become On using the electric charge charged in the bootstrap capacitor C6 (a current path RT1 illustrated in FIG. 2). One end of the bootstrap capacitor C6 is connected to the drive power supply through the diode D3, and the other end of the bootstrap capacitor C6 is connected to the connection point X1.

By causing the first switching elements Q2 and Q3 and the second switching elements Q4 and Q5 to alternately become On at a predetermined period at least at the time of stable lighting, the drive circuit 2*a* is configured to convert an DC output of the DC/DC converter 1 into an AC output by alternating the polarity of the DC output at a predetermined period.

When the high-pressure discharge lamp LP1 is started up, the abnormality determining unit 4*f* is configured determine presence/absence of an abnormality based on at least one of the output voltage and the output current measured by the measurement unit 3.

Next, the operation of the discharge lamp lighting device A will be described. This discharge lamp lighting device A, as illustrated in FIG. 3, transits to a stable lighting mode MD5 through four operation modes MD1 to MD4.

Figure 3:
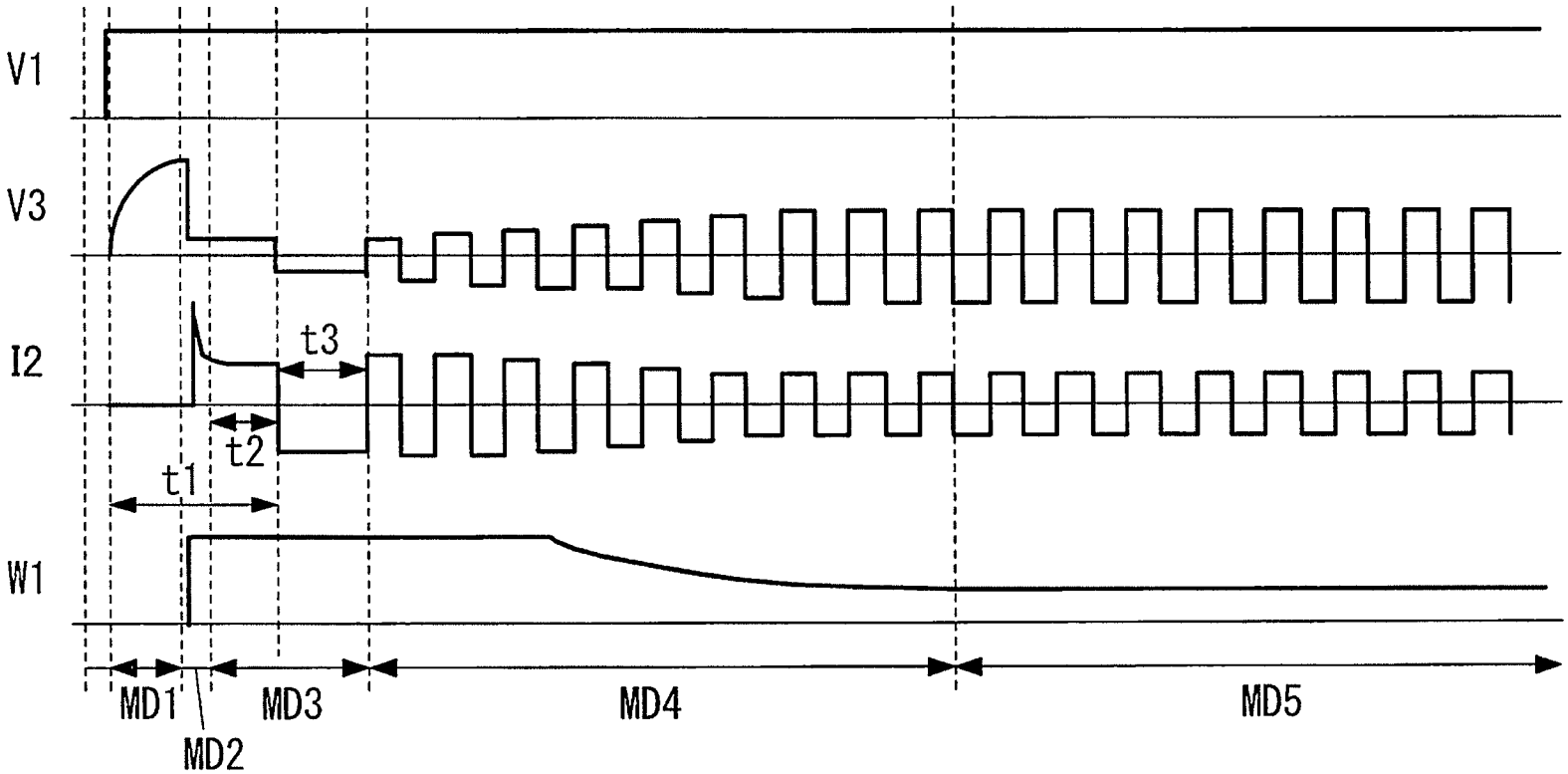
FIG. 3 is a waveform chart that illustrates an operation of the discharge lamp lighting device according to Embodiment 1 from start-up to stable lighting.

The mode MD1 illustrated in FIG. 3 is an operation mode at the unloaded time before the startup of the high-pressure discharge lamp LP1, and the high-pressure discharge lamp LP1 is in an open state. When the power supply switch SW1 is turned on at the time of starting the mode MD1, the control unit 4 starts to operate and starts the voltage boosting operation of the DC/DC converter 1. When the drive unit 10 turns on the switching element Q1 in response to a control signal transmitted from the control unit 4, current flows from the DC power supply E1 to the primary wiring P1 of the transformer T1 and the switching element Q1. At this time, current does not flow in the secondary winding S1 due to a rectification action of the diode D1, and the energy is stored in the transformer T1. Thereafter, when the drive unit 10 turns off the switching element Q1 in response to a control signal transmitted from the control unit 4, current flows through a path of the secondary winding S1→the diode D1→the capacitor C2→the secondary winding S1. Accordingly, the energy stored in the transformer T1 when the switching element Q1 is turned on is transferred to the capacitor C2. The on-duty of the switching element Q1 is controlled by the control unit 4, so that the output voltage V2 of the DC/DC converter 1 is controlled to be a target value. The DC/DC converter 1 performs the voltage boosting operation as described above, so that the output voltage V2 is increased.

Thereafter, when a transition to the startup mode MD2 is made, the control unit 4 turns on the switching elements Q2 and Q5 and turns off the switching elements Q3 and Q4. When the output voltage V2 is gradually increased according to the voltage boosting operation of the DC/DC converter 1, the voltage of the capacitor C4 of the igniter unit 7 is also increased. Meanwhile, when the voltage applied across the capacitor C5 exceeds a predetermined threshold level according to an increase in the output voltage of the startup voltage generating circuit unit 6, the discharge gap SG1 is broken down, and a high voltage is applied to the primary winding P2 of the voltage boosting transformer T2. At this time, a high-voltage pulse (about several tens of kV) acquired by boosting a high voltage applied to the primary side according to the winding ratio is generated in the secondary winding S2. When this high-voltage pulse is applied to the high-pressure discharge lamp LP1, insulation breakdown occurs in the high-pressure discharge lamp LP1, and glow discharge is started. Immediately after the start of the glow discharge, since the electrode temperature of the high-pressure discharge lamp LP1 is low, the fading-away may easily occur. Thus, in this embodiment, in order to suppress the occurrence of the fading-away, a DC phase mode MD3 is arranged in which currents having the same direction are caused to continuously flow to both electrodes for a time longer than that of the time of stable lighting. In addition, during a first period t2 that is a first half of the DC phase mode MD3, the switching elements Q2 and Q5 are turned on, the switching elements Q3 and Q4 are turned off, and current having the same direction as that of the startup mode MD2 is caused to flow in a path of the connection point X1→the high-pressure discharge lamp LP1→the connection point X2. Furthermore, during a second period t3 that is a second half of the DC phase mode MD3, the switching elements Q2 and Q5 are turned off, the switching elements Q3 and Q4 are turned on, and current having a direction opposite to that during the first period t2 is caused to flow in a path of the connection point X2→the high-pressure discharge lamp LP1→the connection point X1.

When it is determined that the temperatures of both electrodes are sufficiently high, the control unit 4 ends the DC phase mode MD3. Then, by alternately turning on the set of the switching elements Q2 and Q5 and the set of the switching elements Q3 and Q4 at a predetermined period by controlling the drive circuit 2*a*, the control unit 4 converts the DC output into an AC output of a rectangular wave and supplies the AC output to the high-pressure discharge lamp LP1. In addition, the control unit 4 compares the target value of the output current that is acquired based on the target value of the output power or the like with a measured value by using the error amplifier 4*d*, and controls the output power W1 of the DC/DC converter 1 by adjusting the on-duty of the switching element Q1 according to the error amount (modes MD4 and MD5). Here, the mode MD4 is an operation mode of a transient state, and the mode MD5 is an operation mode at the time of stable lighting.

As described above, the discharge lamp lighting device A according to this embodiment performs stable lighting of the high-pressure discharge lamp LP1 through the modes MD1 to MD4 described above (stable lighting mode MD5).

Here, the DC/AC inverter 2 according to this embodiment is of a static electric potential type, and the switching elements Q2 and Q5 need to be continuously turned on for a time t1 from the unloaded operation mode MD1 before the startup of the high-pressure discharge lamp LP1 to the first period t2 of the DC phase mode MD3. In order to continuously turn on the switching elements Q2 and Q5 for a predetermined time, it is necessary to store electric charge, which is required for operating the first switching element Q2 to be in the On state for the predetermined time, in the bootstrap capacitor C6 that supplies the electric charge to the gate electrode of the first switching element Q2 disposed on the high potential side. In addition, in this embodiment, in order to improve the starting characteristics of the high-pressure discharge lamp LP1, the operation of the DC/DC converter 1 is started during the charging process of the bootstrap capacitor C6, and a time for the output voltage V2 of the DC/DC converter 1 to be boosted to a predetermined voltage is shortened.

Here, the On/Off operations of the switching elements Q2 to Q5 configuring the DC/AC inverter 2 and the charging operation of the bootstrap capacitor C6 arranged on the side of the first switching element Q2 disposed on the high potential side will be described with reference to FIG. 2. The On/Off operations of the switching elements Q2 to Q5 are determined based on control signals LF1 and LF2 input to the drive circuit 2*a* from the drive control unit 4*e* of the control unit 4.

The control signals input to the drive circuit 2*a* from the drive control unit 4*e* are boosted by the drive circuits 22 and 24 to voltages required for driving the gate electrodes. Here, since the second switching element Q4 disposed on the low potential side is turned off when the first switching element Q2 disposed on the high potential side is turned on, the drive circuit 22 supplies an On voltage to the gate electrode of the first switching element Q2 using the electric charge charged in the bootstrap capacitor C6. While the first switching element Q2 is turned on, the bootstrap capacitor C6 is in a discharged state but is not charged, and then, when the first switching element Q2 is turned off, and the second switching element Q4 is switched to be turned on, the bootstrap capacitor C6 is charged again. At this time, as denoted by a dotted line RT2 in FIG. 2, current flows through a path of the diode D3 from the drive power supply→the bootstrap capacitor C6→the second switching element Q4, so that the bootstrap capacitor C6 is charged. Accordingly, in a case where the bootstrap capacitor C6 is to be charged, it is necessary for the control unit 4 to output a signal LF1 turning off the first switching element Q2 disposed on the high potential side and a signal LF2 turning on the second switching element Q4 disposed on the low potential side. Such a charging system is called a bootstrap system. In addition, also for the first switching element Q3 and the second switching element Q5 configuring the second arm, a bootstrap capacitor (not illustrated in the figure) used for driving the first switching element Q3 disposed on the high potential side is charged using a similar method, and thus, description thereof will not be presented.

Figure 4:
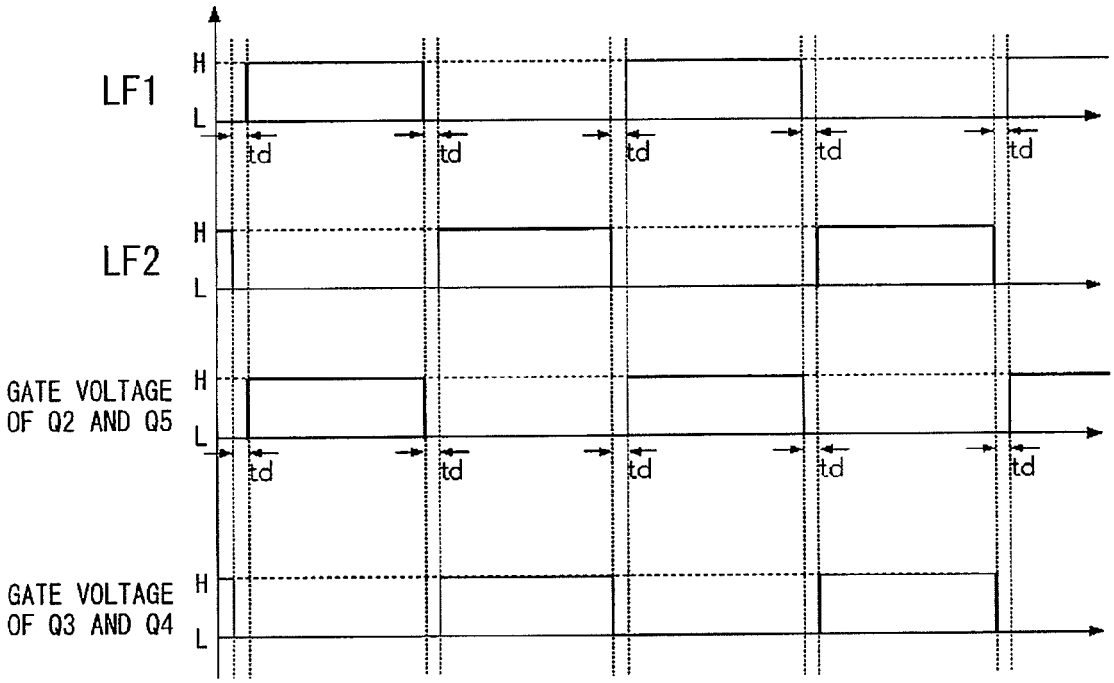
FIG. 4 is a waveform chart that illustrates an operation of a DC/AC inverter of the discharge lamp lighting device according to Embodiment 1.

In addition, in the transient operation mode MD4 and the stable lighting mode MD5, the control unit 4 alternately controls the switching elements Q2 to Q5, so that the DC output of the DC/DC converter 1 is converted into an AC and is supplied to the high-pressure discharge lamp LP1. As illustrated in FIG. 4, in a case where signal level of the signal LF1 is a high level H, and the signal level of the signal LF2 is a low level L, the gate voltages of the switching elements Q2 and Q5 become the high level H, and the switching elements Q2 and Q5 are turned on, and the switching elements Q3 and Q4 are turned off. On the other hand, in a case where signal level of the signal LF1 is the low level L, and the signal level of the signal LF2 is the high level H, the gate voltages of the switching elements Q3 and Q4 become the high level H, and the switching elements Q3 and Q4 are turned on, and the switching elements Q2 and Q5 are turned off. Then, by alternately repeating the period of the high level H of the signal LF1 and the period of the high level H of the signal LF2, the set of the switching elements Q2 and Q5 and the set of the switching elements Q3 and Q4 are alternately switched between On/Off, so that the output of the DC/DC converter 1 is converted into an AC. In addition, between the period of the high level H of the signal LF1 and the period of the high level H of the signal LF2, in order not to simultaneously turn on all the switching elements Q2 to Q5, a dead time td is provided at which the signal levels of both the signals LF1 and LF2 are at the low level L. In addition, when both the signals LF1 and LF2 are at the high level H, the first switching elements Q2 and Q3 disposed on the high potential side are turned off, and the second switching elements Q4 and Q5 disposed on the lower potential side are turned on, and an operation of charging the bootstrap capacitor driving the first switching elements Q2 and Q3 is performed.

Here, also in this embodiment, when the load (for example, the high-pressure discharge lamp LP1) 11 forms a short circuit at the time of starting up the high-pressure discharge lamp LP1, there is a possibility that an overcurrent flows in the circuit according to the electric charge stored in the capacitors C2 and C4 after the start of the operation of the DC/AC inverter 2.

Figure 5:
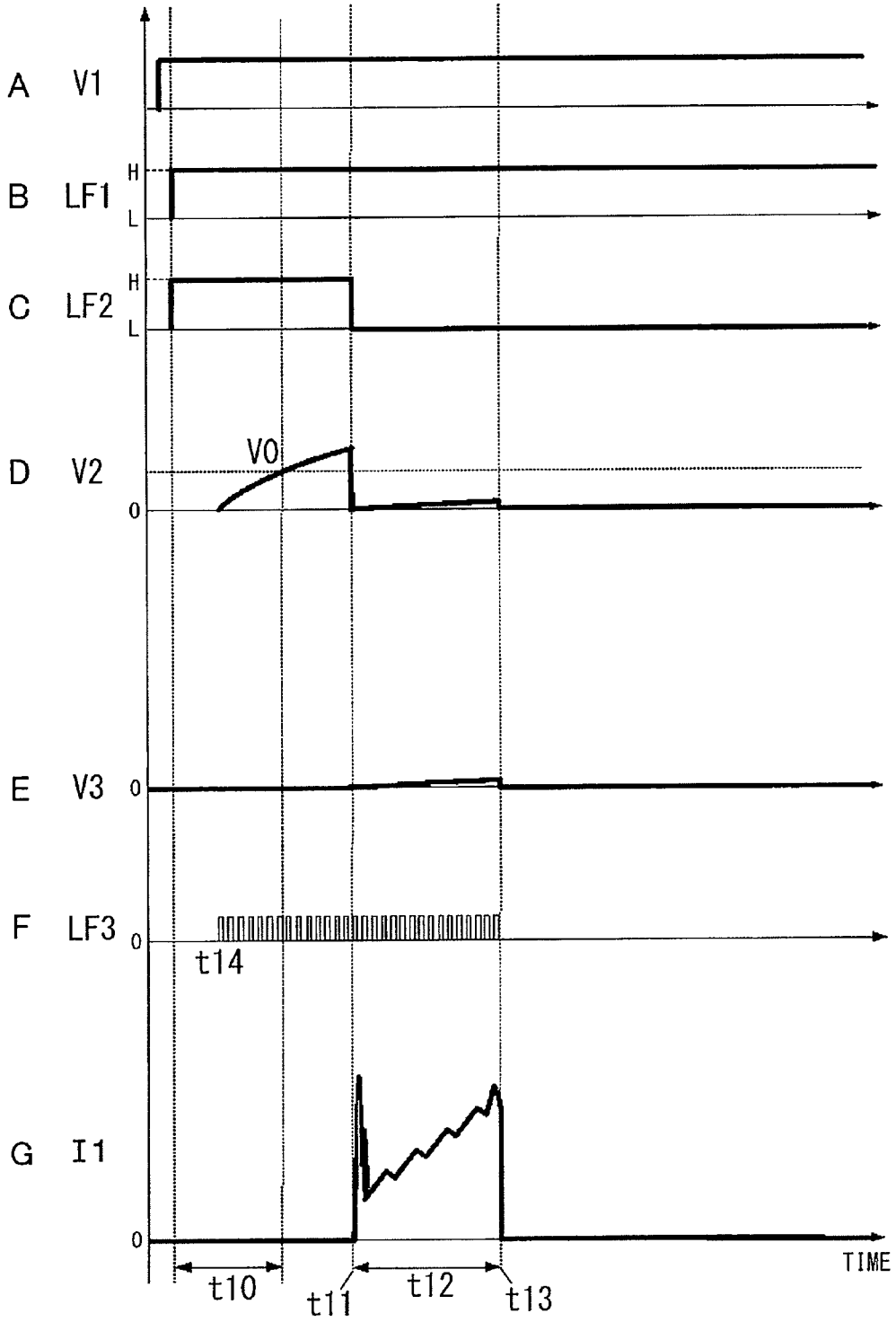
FIGS. 5A to 5G are waveform charts of units that illustrate the operation of the discharge lamp lighting device according to Embodiment 1.
Figure 6:
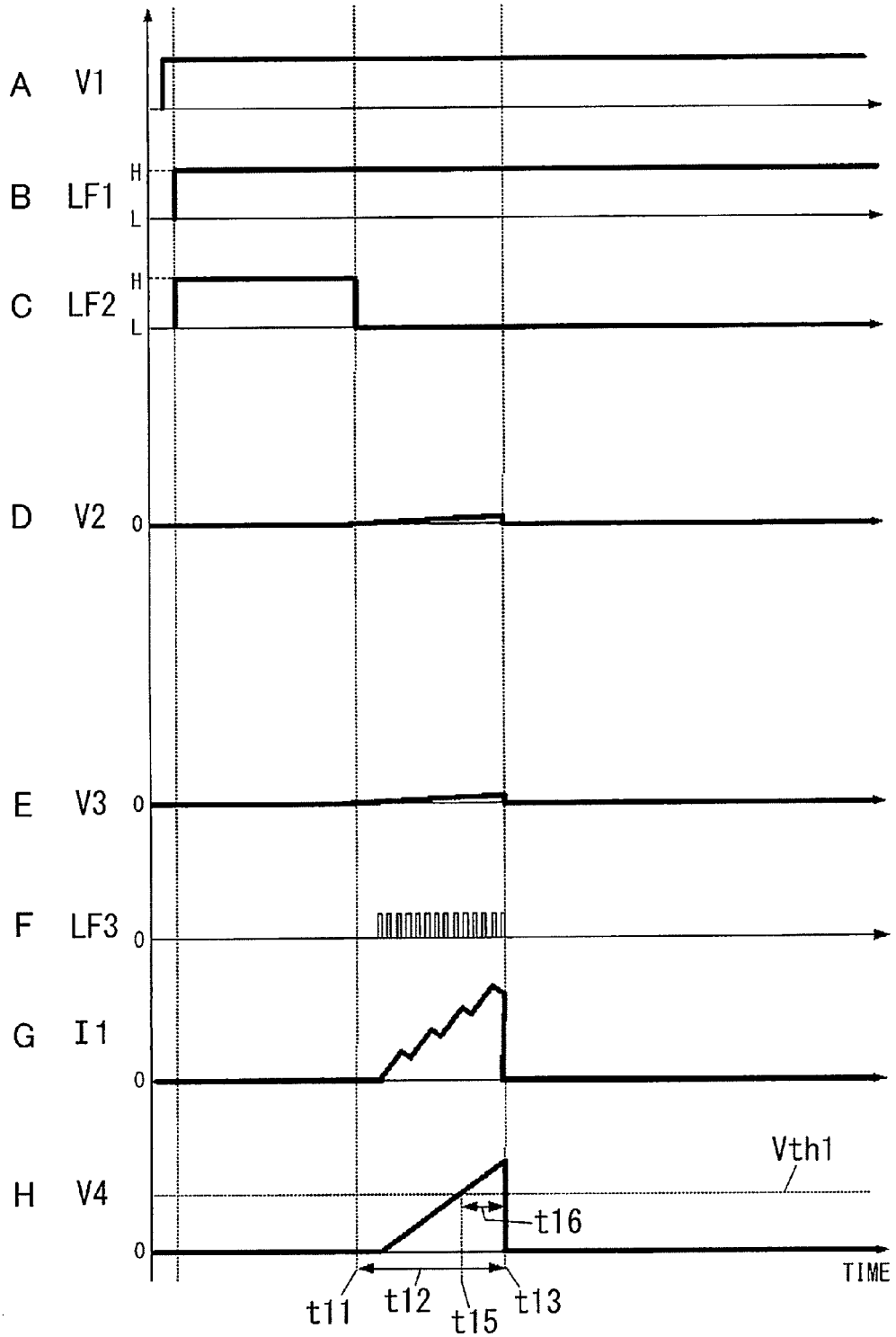
FIGS. 6A to 6H are waveform charts of units that illustrate the operation of a discharge lamp lighting device according to Embodiment 2.
Figure 7:
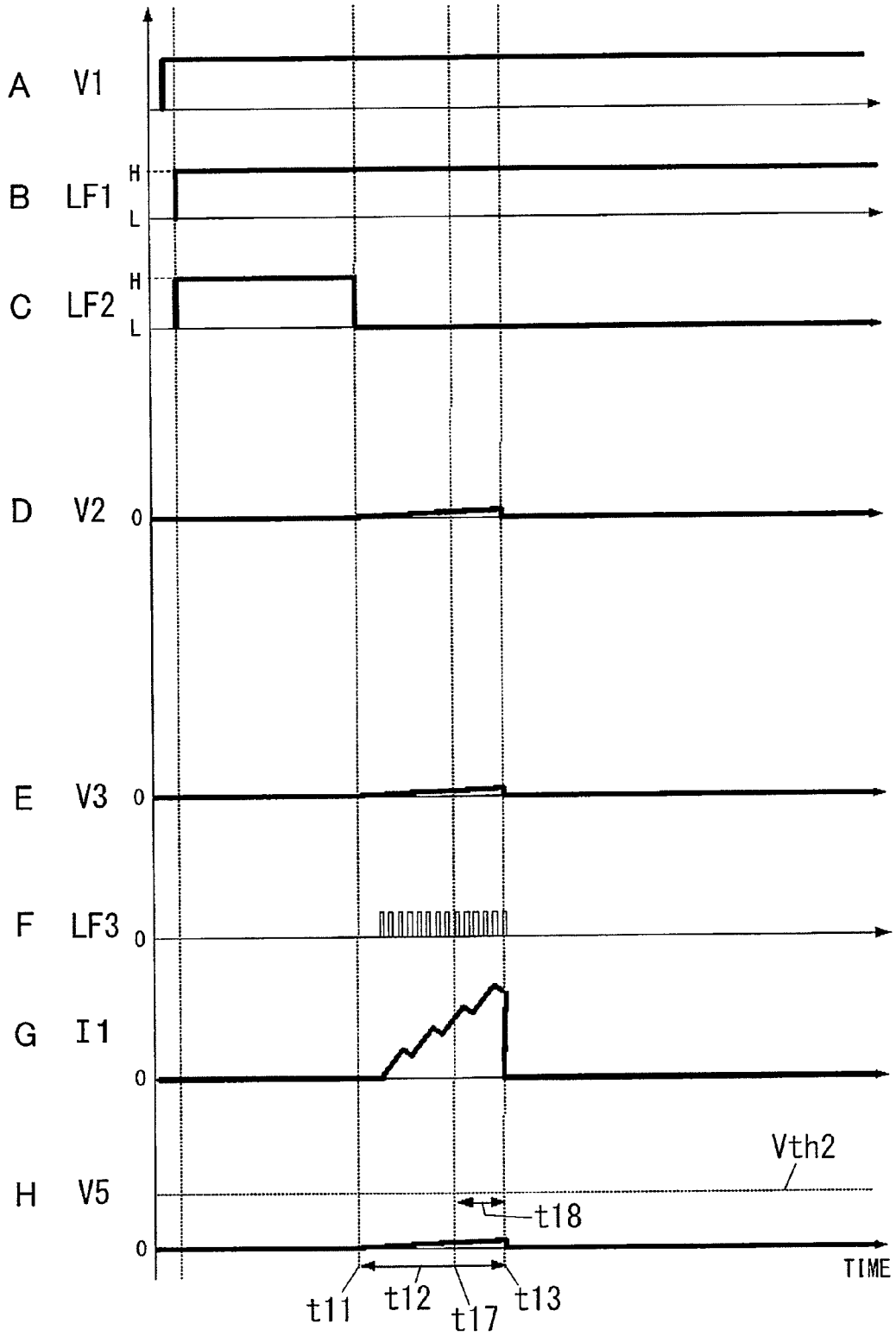
FIGS. 7A to 7H are waveform charts of units that illustrate a different operation of the discharge lamp lighting device according to Embodiment 2.
Figure 8:
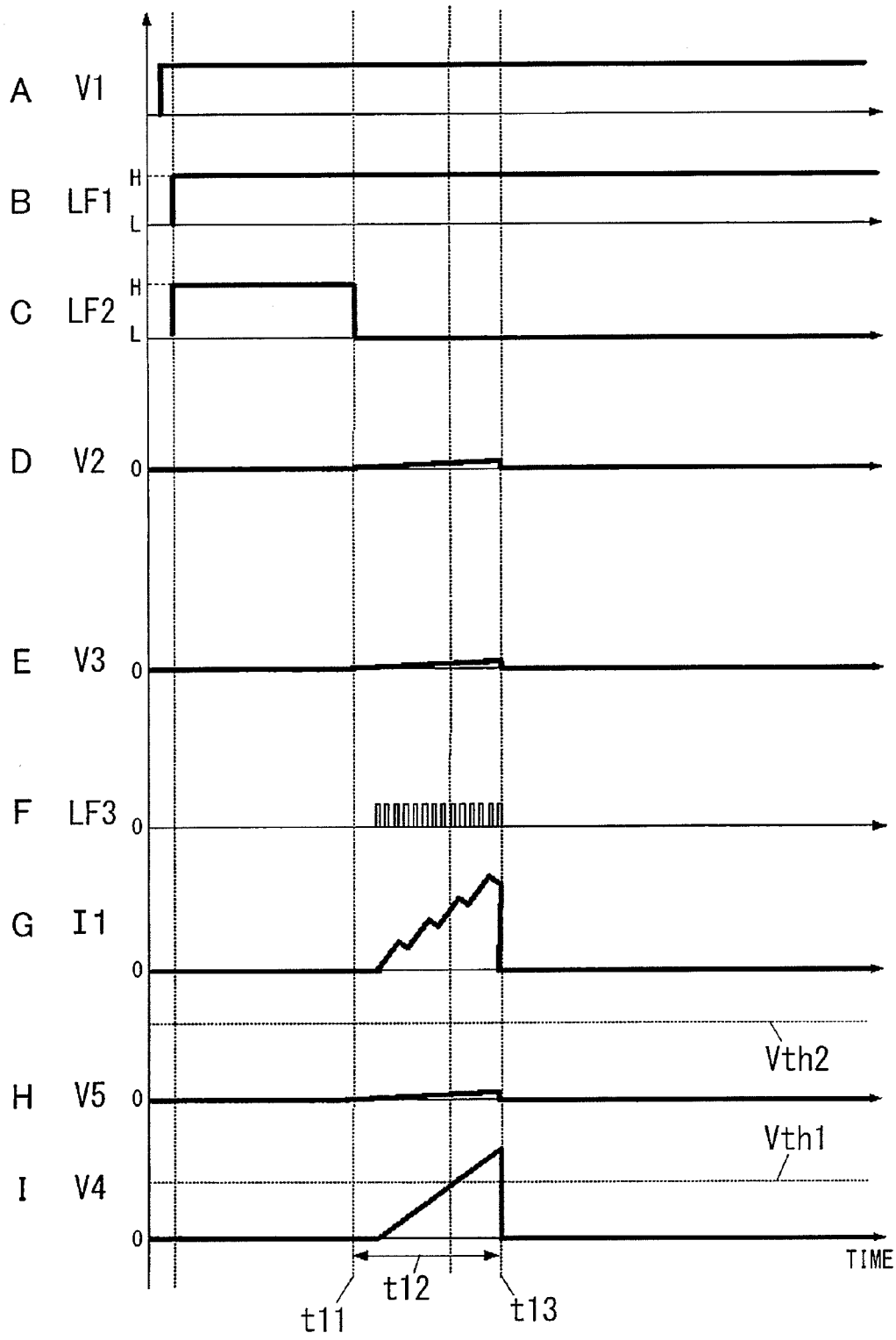
FIGS. 8A to 8I are waveform charts of units that illustrate another different operation of the discharge lamp lighting device according to Embodiment 2.
Figure 9:
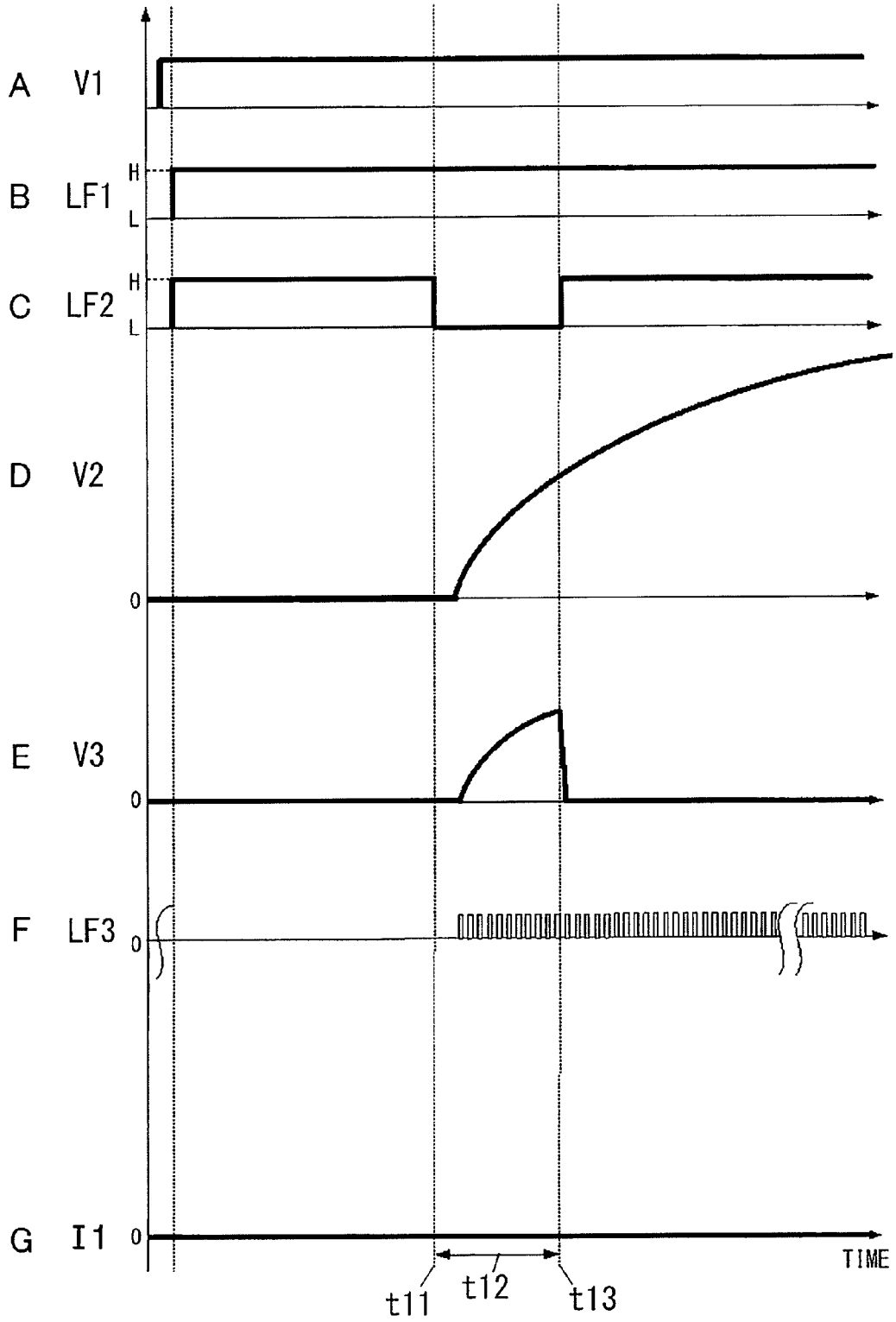
FIGS. 9A to 9G are waveform charts of units that illustrate still another different operation of the discharge lamp lighting device according to Embodiment 2.
Figure 10:
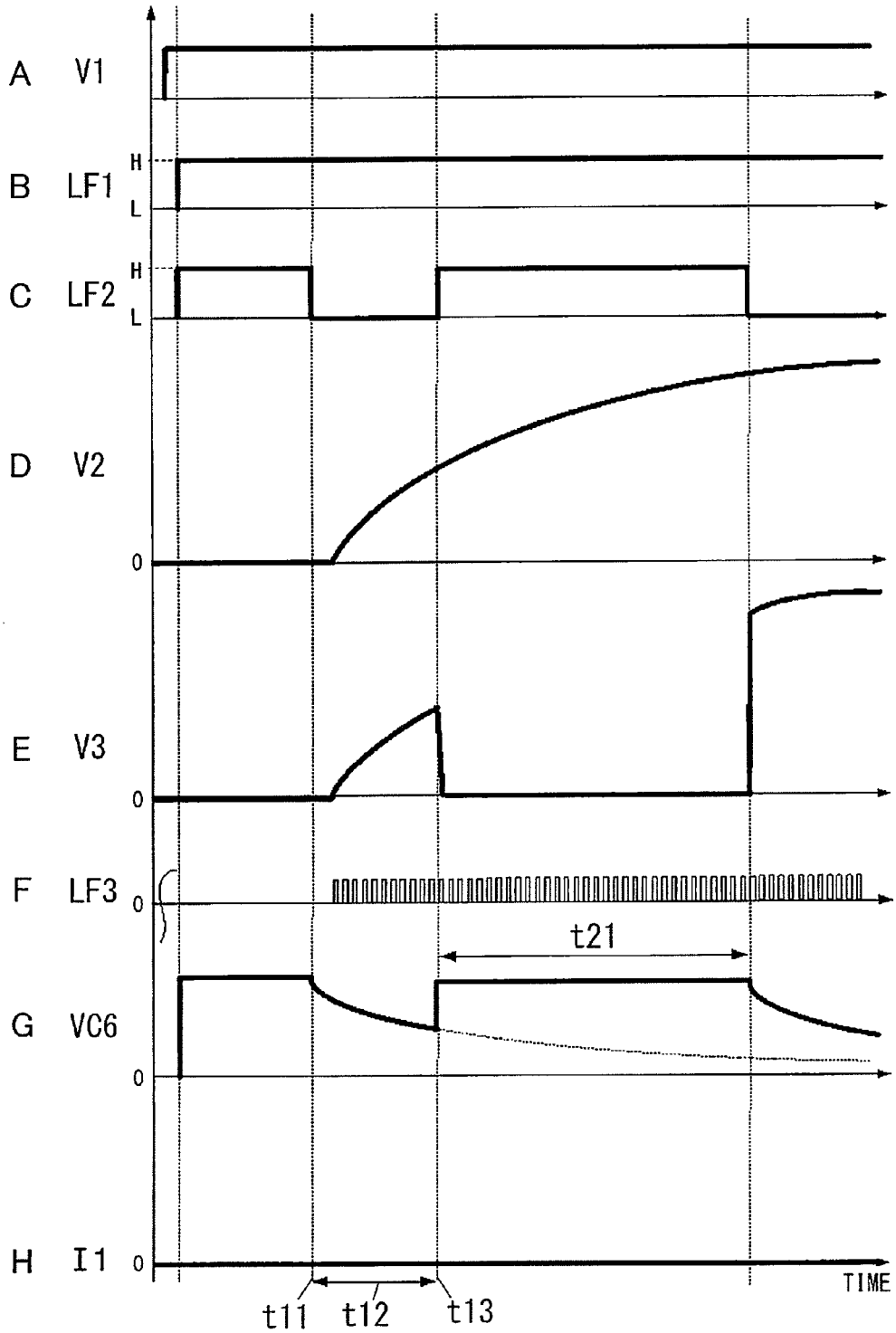
FIGS. 10A to 10H are waveform charts of units that illustrate yet another different operation of the discharge lamp lighting device according to Embodiment 2.

Thus, in this embodiment, as illustrated in FIGS. 5A to 5G, when the DC power supply E1 is started to be supplied, before time t11 when the DC/DC converter 1 starts to operate and before the arrival of the output voltage V2 thereof at a predetermined voltage V0, the control unit 4 starts an operation of charging the bootstrap capacitor (a period t10 illustrated in FIGS. 5A to 5G). Here, the predetermined voltage V0, for example, is a threshold voltage (about 15 V) of the output voltage for which the load is determined to form a short circuit by the control unit 4. FIGS. 5A to 5G are waveform diagrams of the units at the startup time. FIG. 5A illustrates the input voltage V1 of the DC/DC converter 1, FIG. 5B illustrates the signal LF1 transmitted from the control unit 4, and FIG. 5C illustrates the signal LF2 transmitted from the control unit 4. In addition, FIG. 5D illustrates the output voltage V2 of the DC/DC converter 1, and FIG. 5E illustrates the voltage V3 applied to the high-pressure discharge lamp LP1. Furthermore, FIG. 5F illustrates the signal LF3 transmitted from the control unit 4, and FIG. 5G illustrates the output current I1 flowing through the high-pressure discharge lamp LP1.

Then, at the time t11 after the completion of the charging of the bootstrap capacitor, the control unit 4 applies the output voltage V2 of the DC/DC converter 1 to the load (the high-pressure discharge lamp LP1) by turning on the switching elements Q2 and Q5 of the DC/AC inverter 2. Until a predetermined time t12 elapses after the time t11, the abnormality determining unit 4*f* of the control unit 4 determines presence/absence of an abnormality of the load based on at least one of the output voltage V3 (actually the voltage V5) and the output current I1 (actually, the voltage V4) measured by the measurement unit 3. This time t12 is a determination period for determining presence/absence of an abnormality (for example, formation of a short circuit or a ground fault of the load) of the load.

In a case where the load forms a short circuit, the load impedance is markedly decreased to be lower than that of a normal time, and accordingly, an electric potential difference generated between the output terminals of the DC/DC converter 1 is markedly decreased to be lower than that of the normal time, so that an overcurrent flows between the output terminals of the DC/AC inverter 2.

In a case where the presence/absence of an abnormality is determined based on the output voltage for the load, the abnormality determining unit 4*f* compares a voltage V5 that is proportional to the output voltage V3 with a voltage value corresponding to a predetermined threshold voltage. Then, in a case where the output voltage V3 is the threshold voltage or lower, in other words, in a case where the voltage V5 is a voltage corresponding to the threshold voltage or lower, the abnormality determining unit 4*f* determines that an abnormality has occurred. On the other hand, in a case where the voltage V5 is higher than the voltage corresponding to the threshold voltage, the abnormality determining unit 4*f* determines that no abnormality is present.

On the other hand, in a case where the presence/absence of an abnormality is determined based on the output current for the load, the abnormality determining unit 4*f* compares a voltage V4 that is proportional to the output current I1 with a voltage value corresponding to a predetermined threshold current. Then, in a case where the output current I1 is the threshold current or higher, in other words, in a case where the voltage V4 is a voltage corresponding to the threshold current or higher, the abnormality determining unit 4*f* determines that an abnormality has occurred. On the other hand, in a case where the voltage V4 is lower than the voltage corresponding to the threshold current, the abnormality determining unit 4*f* determines that no abnormality is present.

In a case where absence of an abnormality is determined by the abnormality determining unit 4*f* in the determination period t12, the control unit 4 continues the startup operation (the unloaded operation mode MD1) and performs stable lighting of the high-pressure discharge lamp LP1 through the modes MD2 to MD4 described above. On the other hand, in a case where presence of an abnormality is determined by the abnormality determining unit 4*f* in the determination period t12, the control unit 4 does not continue the startup operation but stops the operations of the DC/DC converter 1 and the DC/AC inverter 2 (time t13 illustrated in FIGS. 5A to 5G).

The discharge lamp lighting device according to this embodiment described above includes the DC/DC converter 1, the DC/AC inverter 2, the drive unit (the drive circuit 2*a*), the measurement unit 3, and the control unit 4. The DC/DC converter 1 is configured to convert an input voltage V1 input from the DC power supply E1 into a voltage value that is necessary for lighting the discharge lamp LP1 by switching the input voltage V1. The DC/AC inverter 2 is configured by the bridge circuit in which at least one series circuit of the first switching elements Q2 and Q3 disposed on the high potential side and the second switching elements Q4 and Q5 disposed on the low potential side is connected between the output terminals of the DC/DC converter 1, and is configured to convert the DC output of the DC/DC converter 1 into an AC output, and supply the AC output to the load including the discharge lamp LP1. The drive unit is configured to convert the DC output of the DC/DC converter 1 into an AC output acquired by alternating the polarity of the DC output at a predetermined period by alternately turning on the first switching elements Q2 and Q3 and the second switching elements Q4 and Q5 at a predetermined period at least at the time of stable lighting. The measurement unit 3 is configured to measure at least one of the output voltage V3 and the output current I1 for the load. When a measured value acquired by the measurement unit 3 is in an abnormal range, the control unit 4 is configured to decrease the power to be supplied to the discharge lamp LP1 to be lower than that of the normal time. The drive unit includes the capacitor (the bootstrap capacitor C6) that supplies, to the control electrodes of the first switching elements Q2 and Q3 disposed on the high potential side, electric charge that is necessary for turning on the first switching elements Q2 and Q3 when the second switching elements Q4 and Q5 disposed on the low potential side are turned off. The capacitor is charged when the second switching elements Q4 and Q5 are turned on. When the discharge lamp LP1 is started to operate, the charging of the capacitor is started before the DC/DC converter 1 is started to operate, and, the control unit 4 has the determination period t12 for determining whether or not an abnormality is present based on a measured value acquired by the measurement unit 3 in a state in which the DC/DC converter 1 and the DC/AC inverter 2 are operated after the completion of the charging of the capacitor.

As above, when the discharge lamp is started up (the unloaded operation mode MD1 illustrated in FIG. 3), the control unit 4 starts to charge the bootstrap capacitor before the DC/DC converter 1 is started to operate. Then, the determination period t12 is provided in which the control unit 4 determines whether or not an abnormality is present based on a measured value acquired by the measurement unit 3 in a state in which the DC/DC converter 1 and the DC/AC inverter 2 are operated after the completion of the charging of the bootstrap capacitor. Then, when the measured value acquired by the measurement unit 3 is in an abnormal range, the control unit 4 decreases the power to be supplied to the load to be lower than that of the normal time (at the time of stable lighting).

Accordingly, after the capacitor operating the first switching elements disposed on the high potential side is charged, in a state in which the DC/AC inverter 2 is started to operate, the presence/absence of an abnormality can be determined based on the measured value acquired by the measurement unit 3. Then, in a case where the presence of an abnormality is determined during the determination period t12, the control unit 4 decreases the power to be supplied to the high-pressure discharge lamp LP1 to be lower than that of the normal time, and accordingly, an overcurrent flowing through the circuit is decreased, so that heat stress to be applied to the circuit components is suppressed.

In addition, in a case where the presence of an abnormality is determined by the abnormality determining unit 4*f* during the determination period t12, the control unit 4 may be configured to turn off all of the four switching elements Q2 to Q5 configuring the DC/AC inverter 2 by setting the signal levels of both the signals LF1 and LF2 to the low level L. In such a case, the flow of an overcurrent in the DC/AC inverter 2 is suppressed, and the circuit can be protected. In addition, in a case where the presence of an abnormality is determined by the abnormality determining unit 4*f* during the determination period t12, the control unit 4 may be configured to turn off at least the two first switching elements Q2 and Q3 disposed on the high potential side. Also in such a case, the flow of an overcurrent in the DC/AC inverter 2 is suppressed, and the circuit can be protected.

As in this discharge lamp lighting device, when an abnormality is determined to have occurred during the determination period t12, it is preferable that the control unit 4 is configured to turn off at least all the first switching elements Q2 and Q3 disposed on the high potential side within a predetermined time.

In addition, the determination period t12 is preferably set to a short time as possibly as can so as not to have bad influence on the starting ability of the high-pressure discharge lamp LP1. Furthermore, the output voltage V2 of the DC/DC converter 1 is preferably set according to a rated voltage of the discharge lamp (the high-pressure discharge lamp LP1) of the load, and, in the case of a high-pressure discharge lamp that is generally used, it is preferable that the output voltage is set in the range of 350 V to 450 V. In addition, a time during which the bootstrap capacitor is charged is preferably set to a level of a time in which the charging of the bootstrap capacitor is completed and may be appropriately set according to the capacitance of the bootstrap capacitor. In addition, a frequency at which the DC/AC inverter 2 alternates the polarity of the output voltage of the DC/DC converter 1 is preferably set between 200 to 600 Hz.

(Embodiment 2)

A discharge lamp lighting device A according to Embodiment 2 will be described with reference to FIGS. 6A to 10H.

In the discharge lamp lighting device A according to this embodiment, an abnormality determining operation at the startup time is different from that of the discharge lamp lighting device A according to Embodiment 1, and the circuit configuration and the other operations are similar to those of the discharge lamp lighting device A according to Embodiment 1. Thus, the same reference numeral is assigned to a constituent element that is common to the discharge lamp lighting device A according to Embodiment 1, and description thereof will not be presented.

FIGS. 6A to 6H are waveform diagrams of units at the startup time (the unloaded operation mode MD1 described in Embodiment 1). FIG. 6A illustrates the input voltage V1 of a DC/DC converter 1, FIG. 6B illustrates a signal LF1 transmitted from a control unit 4, and FIG. 6C illustrates a signal LF2 transmitted from the control unit 4. In addition, FIG. 6D illustrates the output voltage V2 of the DC/DC converter 1, and FIG. 6E illustrates a voltage V3 applied to a high-pressure discharge lamp LP1. Furthermore, FIG. 6F illustrates a signal LF3 transmitted from the control unit 4, FIG. 6G illustrates an output current I1 flowing through the high-pressure discharge lamp LP1, and FIG. 6H illustrates a voltage V4 that is generated in a resistor R4 used for detecting an output current.

In this embodiment, when a DC power supply E1 is started to be supplied, before the operation of the DC/DC converter 1 is started, the control unit 4 starts the operation of charging a bootstrap capacitor. At time t11 after the completion of the charging of the bootstrap capacitor, the control unit 4 applies a voltage to the load by turning on switching elements Q2 and Q5 of a DC/AC inverter 2 and then starts the voltage boosting operation of the DC/DC converter 1. Then, until a predetermined time t12 elapses after the time t11, an abnormality determining unit 4*f* of the control unit 4 determines the presence/absence of an abnormality of the load based on the output current I1 measured by a measurement unit 3, actually, a voltage V4 generated in a resistor R4 used for detecting an output current. In other words, the abnormality determining unit 4*f* compares the voltage V4 measured by the measurement unit 3 with a voltage Vth1 corresponding to a predetermined threshold current. Then, in a case where the voltage V4 is the voltage Vth1 or higher (in other words, in a case where the output current I1 is a threshold current or higher), the abnormality determining unit 4f determines that an abnormality has occurred. On the other hand, in a case where the voltage V4 is lower than the voltage Vth1, the abnormality determining unit 4f determines that no abnormality is present. This time t12 is a determination period in which the presence/absence of an abnormality (for example, formation of a short circuit or a ground fault) of the load is determined. Here, the threshold current is set to a current value that is larger than the range of the output current I1 flowing though the high-pressure discharge lamp LP1 of a case where the load including the high-pressure discharge lamp LP1 is normal and is smaller than current generated at the time of an abnormality such as formation of a short circuit or a ground fault.

In a case where the load forms a short circuit, the load impedance is markedly decreased to be lower than that of a normal time, and accordingly, an electric potential difference generated between the output terminals of the DC/DC converter 1 is markedly decreased to be lower than that of the normal time, so that the output current I1 that is the threshold current or higher flows between the output terminals of the DC/AC inverter 2. In this case, the voltage V4 measured by the measurement unit 3 is the voltage Vth1 corresponding to the threshold current or higher. Accordingly, since the voltage V4 is the voltage Vth1 or higher at time t15 during the determination period t12, the control unit 4 determines that the load forms a short circuit and does not continue the startup operation but stops the operations of the DC/DC converter 1 and the DC/AC inverter 2 (time t13). In addition, after the voltage V4 is the voltage Vth1 or higher at the time t15, until the operations of the DC/DC converter 1 and the DC/AC inverter 2 are stopped by the control unit 4, a delay of a time t16 occurs. This time delay is due to a delay in the circuit feeding back the current value or a delay of the process performed by the control unit 4.

On the other hand, in a case where the load is normal, during the determination period t12 described above, the voltage V4 measured by the measurement unit 3 is lower than the voltage Vth1. Thus, since the voltage V4 is lower than the voltage Vth1, the abnormality determining unit 4f determines absence of an abnormality, and the control unit 4 continues the startup operation and starts and lights the high-pressure discharge lamp LP1.

As described above, also in the discharge lamp lighting device A according to this embodiment, when the discharge lamp is started up, the control unit 4 starts charging the bootstrap capacitor before the DC/DC converter 1 is started to operate. Then, after the completion of the charging of the bootstrap capacitor, the voltage boosting operation of the DC/DC converter 1 is started, and the DC/AC inverter 2 is operated (in other words, the switching elements Q2 and Q5 are turned on), and the output of the DC/DC converter 1 is applied to the high-pressure discharge lamp LP1. A determination period t12 is provided in which the control unit 4 determines whether or not an abnormality is present based on a measured value acquired by the measurement unit 3 in such a state. Then, when the measured value acquired by the measurement unit 3 is in an abnormal range, the control unit 4 decreases the power to be supplied to the load to be lower than that of the normal time (at the time of stable lighting).

Accordingly, after the capacitor operating the first switching elements disposed on the high potential side is charged, in a state in which the DC/AC inverter 2 is started to operate, and the DC/DC converter 1 is started to operate, the presence/absence of an abnormality can be determined based on the measured value acquired by the measurement unit 3. Then, in a case where the presence of an abnormality is determined during the determination period t12, the control unit 4 decreases the power to be supplied to the high-pressure discharge lamp LP1 to be lower than that of the normal time, and accordingly, an overcurrent flowing through the circuit is decreased, so that heat stress to be applied to the circuit components is suppressed.

In addition, in a case where the presence of an abnormality is determined by the control unit 4 during the determination period t12, the control unit 4 maybe configured to turn off all of the four switching elements Q2 to Q5 configuring the DC/AC inverter 2 by setting the signal levels of both the signals LF1 and LF2 to the low level L. In such a case, the flow of an overcurrent in the DC/AC inverter 2 is suppressed, and the circuit can be protected. In addition, in a case where the presence of an abnormality is determined by the control unit 4 during the determination period t12, the control unit 4 may be configured to turn off at least all the first switching elements Q2 and Q3 disposed on the high potential side. Also in such a case, the flow of an overcurrent from the DC/DC converter 1 to the DC/AC inverter 2 is suppressed, and the circuit can be protected.

As in the discharge lamp lighting device according to this embodiment, in a case where the measured value acquired by the measurement unit 3 is in the abnormal range during the determination period t12, it is preferable that the control unit 4 is configured to stop the switching operation of the DC/DC converter 1.

As in the discharge lamp lighting device according to this embodiment, it is preferable that the control unit 4, during the determination period t12, is configured to detect the presence/absence of formation of a short circuit in the load as an abnormality based on the measured value acquired by the measurement unit 3.

As in the discharge lamp lighting device according to this embodiment, in a case where the control unit 4 determines absence of an abnormality during the determination period t12, it is preferable that the drive unit is configured to charge the capacitor (bootstrap capacitor) again.

As in the discharge lamp lighting device according to this embodiment, it is preferable that the measurement unit 3 is configured to measure the output current of the DC/DC converter 1 during the determination period t12. In such a case, in a case where a current value measured by the measurement unit 3 is a predetermined threshold current or more, the control unit 4 determines that the formation of a short circuit has occurred in the load.

In this embodiment, during the determination period t12, the measurement unit 3 measures the output current I1 (actually, a voltage V4 that is proportional to the output current I1) for the load. Then, in a case where the output current I1 is a predetermined threshold current or higher (in other words, in a case where the voltage V4 is a voltage Vth1 corresponding to the threshold current or higher), the control unit 4 determines that formation of a short circuit has occurred in the load.

As above, when the formation of a short circuit occurs in the load, an overcurrent flows from the DC/DC converter 1 to the load side. Accordingly, by detecting the overcurrent, the control unit 4 can reliably detect formation of a short circuit by employing a simple circuit configuration. In addition, also in the discharge lamp lighting device A described in Embodiment 1, it is apparent that the control unit 4 may determine the presence/absence of an abnormality based on the output current measured by the measurement unit 3.

In the description presented above, during the determination period t12, while the control unit 4 determines the presence/absence of an abnormality based on the output current I1 for the load, the presence/absence of an abnormality may be determined based on the output voltage V3 for the load.

In other words, during the determination period t12, the measurement unit 3 may measure the output voltage of the DC/DC converter 1. In such a case, in a case where the voltage value measured by the measurement unit 3 is a predetermined threshold voltage or less, the control unit 4 may determine that formation of a short circuit has occurred in the load.

Here, an operation for measuring the output voltage V3 for the load, actually, the voltage V5 that is proportional to the output voltage V3 using the measurement unit 3 and determining the presence/absence of an abnormality based on a measured value using the abnormality determining unit 4*f* will be described with reference to FIGS. 7A to 7H. FIGS. 7A to 7H are waveform diagrams of units at the startup time (the unloaded operation mode MD1 described in Embodiment 1). FIG. 7A illustrates the input voltage V1 of the DC/DC converter 1, FIG. 7B illustrates a signal LF1 transmitted from the control unit 4, and FIG. 7C illustrates a signal LF2 transmitted from the control unit 4. In addition, FIG. 7D illustrates the output voltage V2 of the DC/DC converter 1, and FIG. 7E illustrates a voltage V3 applied to the high-pressure discharge lamp LP1. Furthermore, FIG. 7F illustrates a signal LF3 transmitted from the control unit 4, FIG. 7G illustrates the output current I1 flowing through the high-pressure discharge lamp LP1, and FIG. 7H illustrates the voltage V5 measured by the measurement unit 3.

As illustrated in FIGS. 7A to 7H, at time t11 after the completion of the charging of the bootstrap capacitor, the control unit 4 applies a voltage to the load by turning on switching elements Q2 and Q5 of the DC/AC inverter 2 and then starts the voltage boosting operation of the DC/DC converter 1. Then, until a predetermined time t12 elapses after the time t11 (the determination period described above), an abnormality determining unit 4*f* of the control unit 4 compares the voltage V5 measured by the measurement unit 3 with a voltage Vth2 corresponding to a predetermined threshold voltage. In a case where the load forms a short circuit, the load impedance is markedly decreased to be lower than that of the normal time, and accordingly, an electric potential difference generated between the output terminals of the DC/DC converter 1 is markedly decreased to be lower than that of the normal time, so that an overcurrent flows between the output terminals of the DC/AC inverter 2. Thus, during the determination period t12, in a case where the output voltage V3 is the threshold voltage or lower, in other words, in a case where the voltage V5 is the voltage Vth2 or lower, the abnormality determining unit 4*f* determines that formation of a short circuit has occurred in the load. On the other hand, in a case where the voltage V5 is above the voltage Vth2, the abnormality determining unit 4*f* determines that no abnormality is present. In addition, in consideration of a rise time of the voltage V5, the abnormality determining unit 4*f* determines the presence/absence of formation of a short circuit based on the voltage value V5 at time t17 when a predetermined time elapses after the transition to the determination period t12. Here, while a delay of a time t18 from when the formation of a short circuit is determined to have occurred at time t17 to when the operations of the DC/DC converter 1 and the DC/AC inverter 2 are stopped occurs, this time delay is due to a delay of the process performed by the control unit 4 or the like.

As above, during the determination period t12, in a case where the output voltage V3 is a predetermined threshold voltage or lower, in other words, in a case where the voltage V5 measured by the measurement unit 3 is the voltage Vth2 corresponding to the threshold voltage or lower, the abnormality determining unit 4*f* of the control unit 4 determines that the load has formed a short circuit. When the formation of a short circuit occurs in the load, the output voltage generated in the load is decreased due to a marked decrease in the load impedance, and accordingly, by measuring the decrease in the output voltage, the control unit 4 can reliably detect the formation of a short circuit in the load by employing a simple circuit configuration. In addition, the threshold voltage is set to a voltage value that is lower than the voltage range of a voltage supplied to the load in a case where the load including the high-pressure discharge lamp LP1 is normal and is higher than a voltage generated in the load at the time of the occurrence of an abnormality such as formation of a short circuit or a ground fault. In addition, also in the discharge lamp lighting device A described in Embodiment 1, it is apparent that the control unit 4 may determine the presence/absence of an abnormality based on the output voltage measured by the measurement unit 3.

In addition, during the determination period t12, the abnormality determining unit 4*f* of the control unit 4 may determine the presence/absence of the formation of a short circuit based on both the output current and the output voltage for the load. In other words, during the determination period t12, the measurement unit 3 may measure both the output current and the output voltage of the DC/DC converter 1. In such a case, the control unit 4 may determine that the formation of a short circuit has occurred in the load in a case where a current value measured by the measurement unit 3 is a predetermined threshold current or more, and a voltage value measured by the measurement unit 3 is a predetermined threshold voltage or less.

The operation of determining the presence/absence of an abnormality based on the output current and the output voltage measured by the measurement unit 3 using the abnormality determining unit 4*f* of the control unit 4 will be described with reference to FIGS. 8A to 8I. FIGS. 8A to 8I are waveform diagrams of units at the startup time (the unloaded operation mode MD1 described in Embodiment 1). FIG. 8A illustrates the input voltage V1 of the DC/DC converter 1, FIG. 8B illustrates a signal LF1 transmitted from the control unit 4, and FIG. 8C illustrates a signal LF2 transmitted from the control unit 4. In addition, FIG. 8D illustrates the output voltage V2 of the DC/DC converter 1, and FIG. 8E illustrates a voltage V3 applied to the high-pressure discharge lamp LP1. Furthermore, FIG. 8F illustrates a signal LF3 transmitted from the control unit 4, FIG. 8G illustrates the output current I1 flowing through the high-pressure discharge lamp LP1, FIG. 8H illustrates the voltage V5 measured by the measurement unit 3, and FIG. 8I illustrates the voltage V4 measured by the measurement unit 3.

As illustrated in FIGS. 8A to 8I, at time t11 after the completion of the charging of the bootstrap capacitor, the control unit 4 applies a voltage to the load by turning on switching elements Q2 and Q5 of the DC/AC inverter 2 and then starts the voltage boosting operation of the DC/DC converter 1. Then, until a predetermined time t12 elapses after the time t11 (the determination period t12 described above), an abnormality determining unit 4*f* of the control unit 4 compares the voltage V5 measured by the measurement unit 3 with the voltage Vth2 and compares the voltage V4 measured by the measurement unit 3 with the voltage Vth1. In a case where the load forms a short circuit, the load impedance is markedly decreased to be lower than that of the normal time, and accordingly, an electric potential difference generated between the output terminals of the DC/DC converter 1 is markedly decreased to be lower than that of the normal time, so that an overcurrent flows between the output terminals of the DC/AC inverter 2.

Thus, during the determination period t12, in a case where the output current I1 is the threshold current or higher, and the output voltage V3 is the threshold voltage or lower, in other words, the voltage V4 is the voltage Vth1 or higher, and the voltage V5 is the voltage Vth2 or lower, the abnormality determining unit 4*f* determines that formation of a short circuit has occurred in the load. On the other hand, in a case where the voltage V4 is below the voltage Vth1, or in a case where the voltage V5 is above the voltage Vth2, the control unit 4 determines that no abnormality is present. Here, the threshold current is set to a current value that is higher than the range of the output current I1 flowing through the load in a case where the load including the high-pressure discharge lamp LP1 is normal and is lower than the current generated at the time of the occurrence of an abnormality such as formation of a short circuit or a ground fault. In addition, the threshold voltage is set to a voltage value that is lower than the range of the voltage (the output voltage V3) generated in the load in a case where the load including the high-pressure discharge lamp LP1 is normal and is higher than the voltage generated in the load at the time of the occurrence of an abnormality such as formation of a short circuit or a ground fault.

As above, during the determination period t12, in a case where the output current I1 is in the current range of the short-circuit state, and the output voltage V3 is in the range of the voltage of the short-circuit state, the control unit 4 determines that the formation of a short circuit has occurred in the load. Accordingly, during the startup operation, by detecting an abnormal decrease in the output voltage that occurs according to a load abnormality or an overcurrent flowing through the load, the formation of a short circuit can be reliably detected by using a simple circuit. In addition, also in the discharge lamp lighting device A described in Embodiment 1, it is apparent that the control unit 4 may determine the presence/absence of an abnormality based on both the output current and the output voltage measured by the measurement unit 3.

In addition, in a case where the control unit 4 determines that no abnormality is present during the determination period t12, as illustrated in FIGS. 9A to 9G, the control unit 4 causes the DC/DC converter 1 to continue the operation also after the time t13 when the determination period t12 ends. Here, at the time t13 when the determination period t12 ends, the control unit 4 may recharge the bootstrap capacitor by setting the signal levels of both the signals LF1 and LF2 to the high level H. In such a case, the bootstrap capacitor is charged again after the end of the determination period t12, the On-time of the first switching element Q2 that is turned on during the first period t1 of the startup mode MD2 or the DC phase mode MD3 after that can be maintained to be long.

As illustrated in FIGS. 10A to 10H, when the control unit 4 turns on the switching elements Q2 and Q5 of the DC/AC inverter 2 during the determination period t12, the bootstrap capacitor C6 is discharged, and the voltage VC6 between both ends thereof decreases. For this reason, a time during which the first switching element Q2 can be turned on using the electric charge that is charged in the bootstrap capacitor C6 is shortened. Thus, during a period t21 from the time t13 to the start of the startup mode MD, the control unit 4 performs an operation of charging the bootstrap capacitor C6 by turning on the second switching elements Q4 and Q5. As above, by recharging the bootstrap capacitor C6, electric charge that is necessary for turning on the first switching element Q2 during the first period t1 of the startup mode MD2 or the DC phase mode MD3 after that can be charged.

Thus, even when the bootstrap capacitor C6 not having a large electrostatic capacity is used, the first switching element Q2 disposed on the high potential side can be turned on for a longer time, and a decrease in the size of the circuit can be realized, so that the mounting area can be decreased.

In addition, also in the discharge lamp lighting device A described in Embodiment 1, in a case where the abnormality determining unit 4*f* of the control unit 4 determines that no abnormality is present during the determination period, the control unit 4 may restart the operation of charging the bootstrap capacitor. Accordingly, even in a case where the On time is set to be long so as to prevent fading-away when the operation of the DC/AC inverter 2 is started, by recharging the bootstrap capacitor, the On state of the switching element disposed on the high potential side can be maintained to be long.

(Embodiment 3)

A discharge lamp lighting device A according to Embodiment 3 will be described with reference to FIGS. 11 to 13I.

The discharge lamp lighting device A according to this embodiment includes a non-insulating type DC/DC converter 1, which is different from Embodiments 1 and 2, and the other configurations and operations are similar to those of Embodiments 1 and 2. Thus, the same reference sign is assigned to a constituent element common to Embodiments 1 and 2, and description thereof will not be presented.

The DC/DC converter 1 includes a transformer T3 including windings P3 and S3 that are magnetically coupled, a switching element Q1, a diode D1, and capacitors C1 and C2. The capacitor C1 is connected across a DC power supply E1 through a power supply switch SW1. Across the capacitor C1, the winding P3 of the transformer T3 and the switching element Q1 are connected in series. One end of the winding S3 is connected to a connection point of the winding P3 and the switching element Q1, and, between the other end of the winding S3 and a negative electrode of the DC power supply E1, the capacitor C2 is connected through the diode D1. The DC/DC converter 1 illustrated in the figure is configured by a boost chopper circuit, and the operation thereof is conventionally known, and thus detailed description thereof will not be presented. The On/Off of the switching element Q1 is controlled by the control unit 4, and a constant voltage acquired by boosting the input voltage is generated between both ends of the capacitor C2. Here, as an example, while the boost chopper circuit has been illustrated as the DC/DC converter 1 that is of the non-insulating type, a step-down chopper circuit or a boost/step-down chopper circuit may be used.

Figure 11:
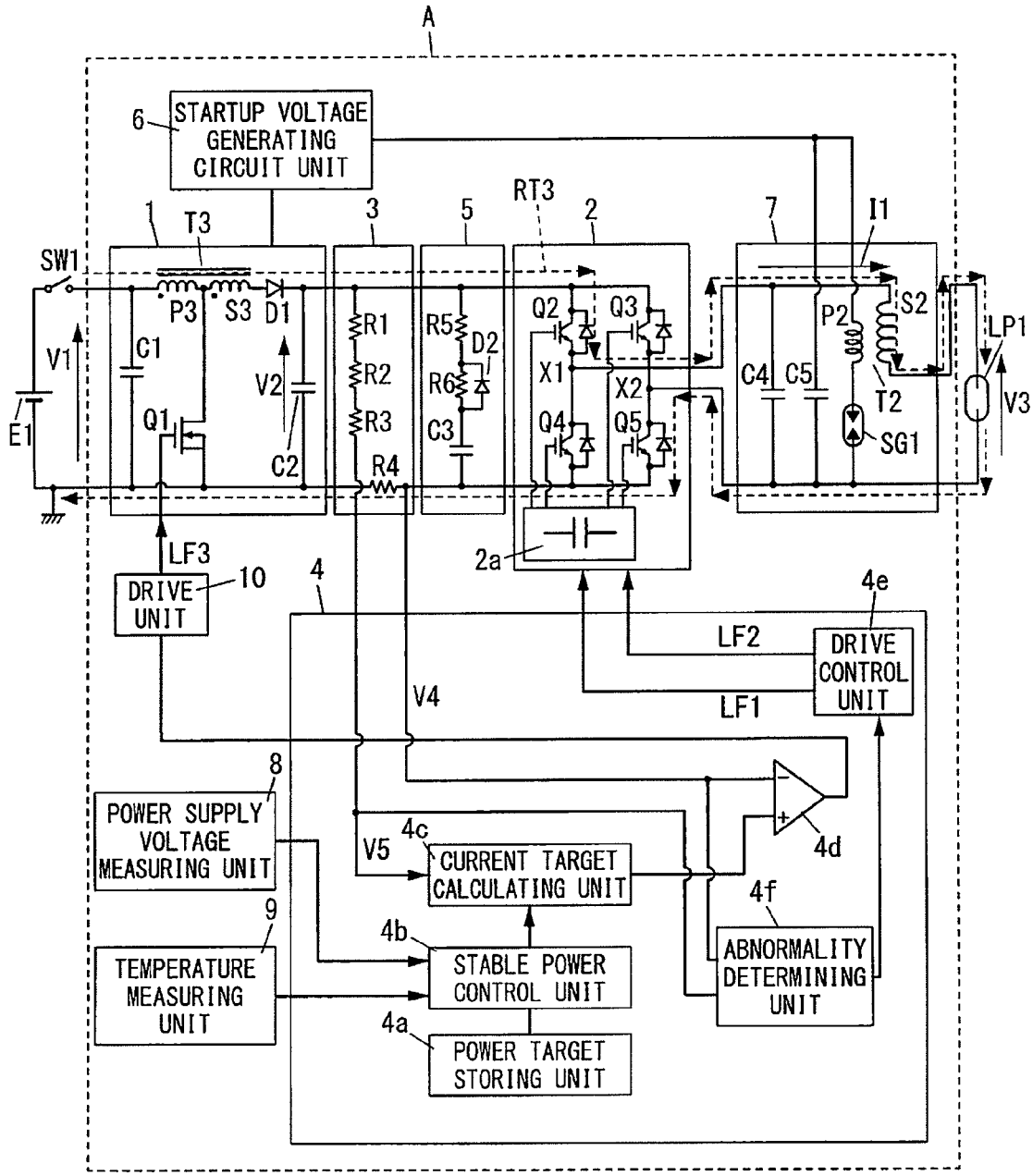
FIG. 11 is a circuit diagram of a discharge lamp lighting device according to Embodiment 3.
Figure 12:
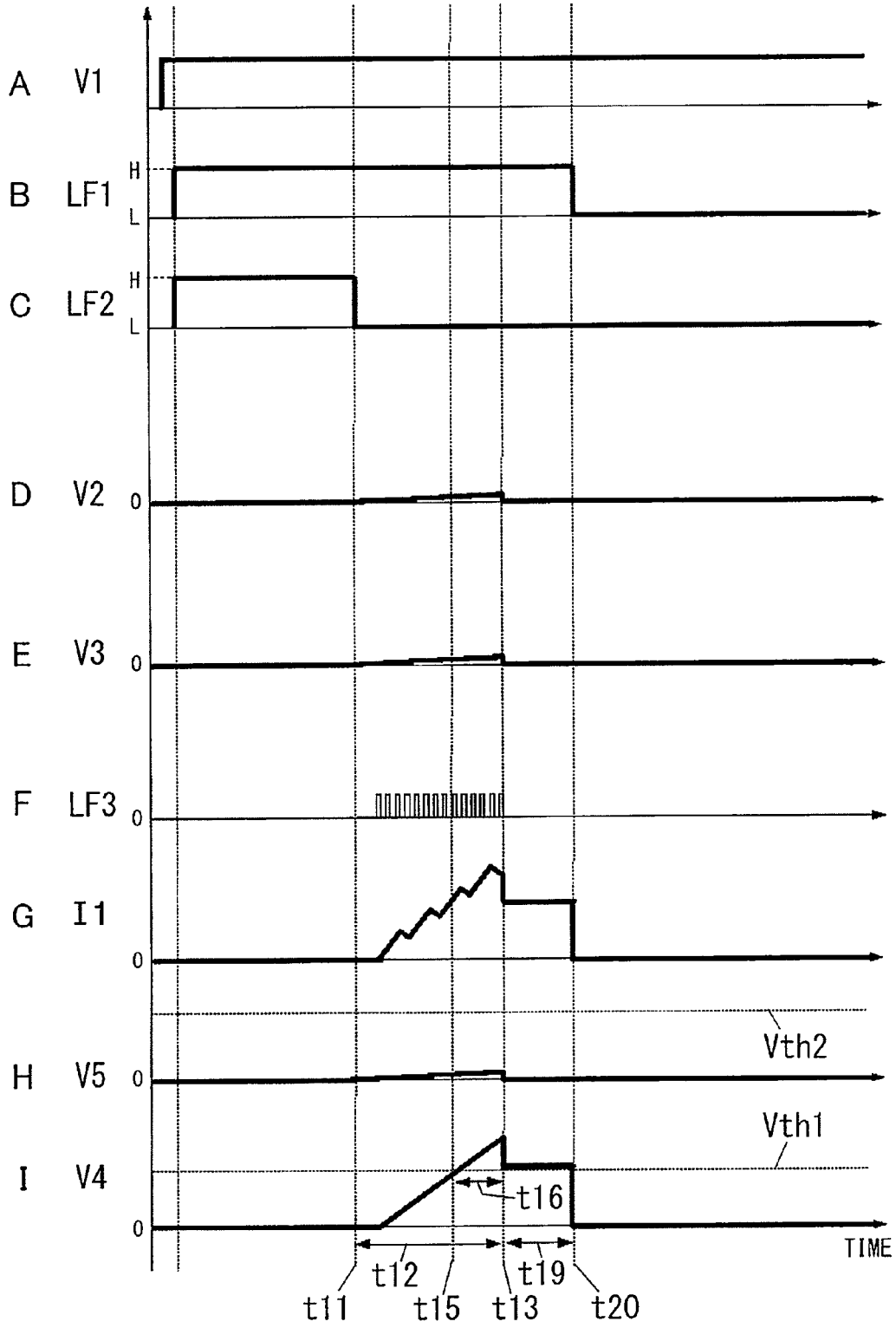
FIGS. 12A to 12I are waveform charts of units that illustrate an operation of the discharge lamp lighting device according to Embodiment 3.
Figure 13:
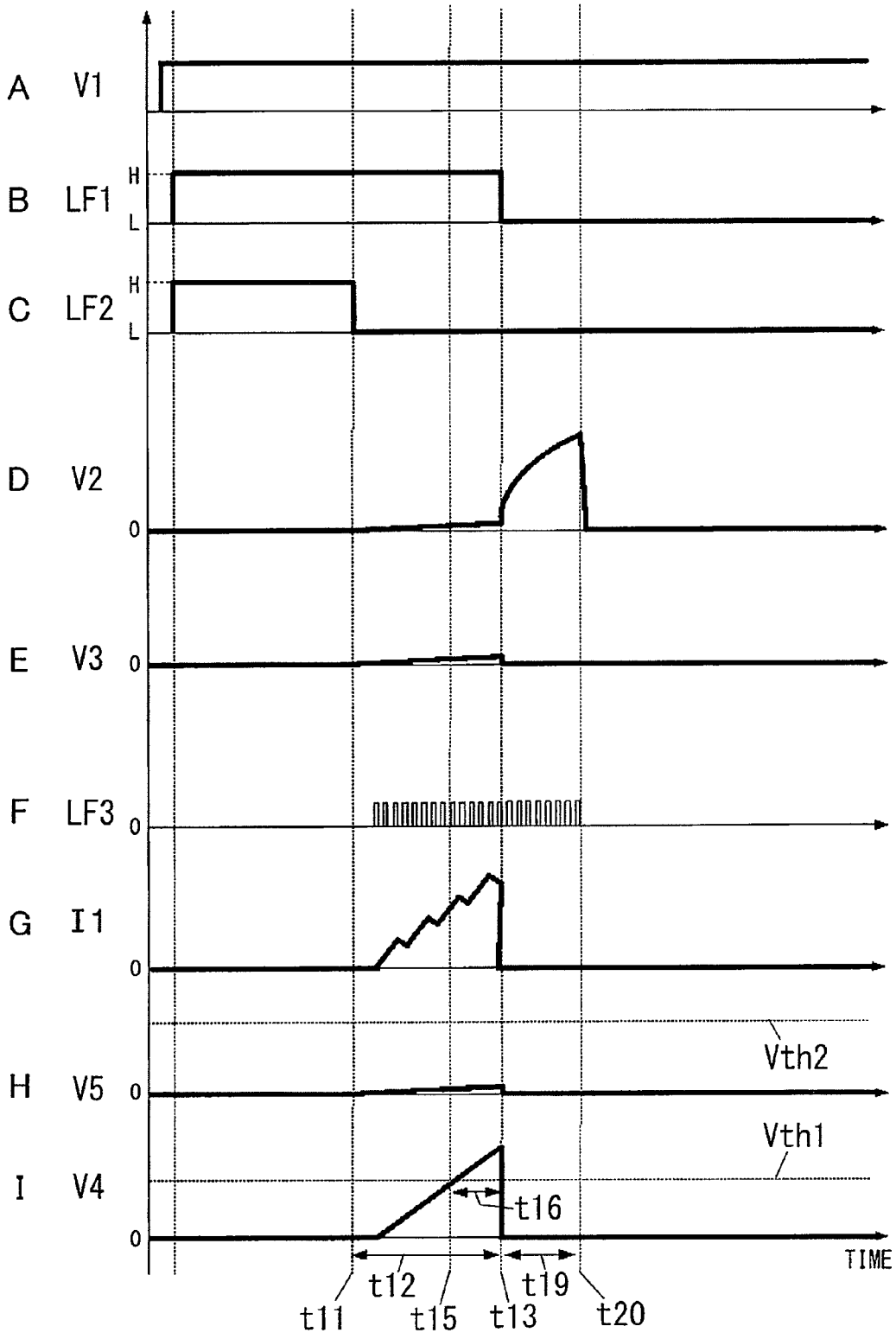
FIGS. 13A to 13I are waveform charts of units that illustrate an operation of the discharge lamp lighting device according to Embodiment 3.

In a case where the DC/DC converter 1 is of the non-insulating type, even in a state in which the DC/DC converter 1 is not operated, when the load forms a short circuit, and switching elements Q2 and Q5 of the DC/AC inverter 2 are turned on, an overcurrent flows in a path denoted by a dotted line RT3 in FIG. 11.

Thus, also in this embodiment, an abnormality of the load is determined at the startup time. In a case where the load is determined to be abnormal, the operations of the DC/DC converter 1 and the DC/AC inverter 2 are stopped. Here, an operation of determining an abnormality of the load at the startup time will be described with reference to FIGS. 12A to 12I. FIGS. 12A to 12I are waveform diagrams of units at the startup time (the unloaded operation mode MD1 described in Embodiment 1). FIG. 12A illustrates the input voltage V1 of the DC/DC converter 1, FIG. 12B illustrates a signal LF1 transmitted from the control unit 4, and FIG. 12C illustrates a signal LF2 transmitted from the control unit 4. In addition, FIG. 12D illustrates the output voltage V2 of the DC/DC converter 1, and FIG. 12E illustrates a voltage V3 applied to the high-pressure discharge lamp LP1. Furthermore, FIG. 12F illustrates a signal LF3 transmitted from the control unit 4, FIG. 12G illustrates the output current I1 flowing through the high-pressure discharge lamp LP1, FIG. 12H illustrates a voltage V5 measured by the measurement unit 3, and FIG. 12I illustrates a voltage V4 measured by the measurement unit 3.

Also in this embodiment, when the DC power supply E1 is started to be supplied, the control unit 4 starts the operation of charging the bootstrap capacitor before the DC/DC converter 1 is started to operate. At time t11 after the completion of the charging of the bootstrap capacitor, the control unit 4 applies a voltage to the load by turning on the switching elements Q2 and Q5 of the DC/AC inverter 2 and then starts the voltage boosting operation of the DC/DC converter 1. Then, until a predetermined time t12 elapses after the time t11, the abnormality determining unit 4*f* of the control unit 4 determines presence/absence of an abnormality in the load based on the voltage V4 (corresponding to the output current I1) and the voltage V5 (corresponding to the output voltage V3) measured by the measurement unit 3.

In other words, the abnormality determining unit 4*f* compares the voltage V4 measured by the measurement unit 3 with the voltage Vth1 corresponding to a predetermined threshold current and compares the voltage V5 measured by the measurement unit 3 with the voltage Vth2 corresponding to a predetermined threshold voltage. Then, in a case where the output current I1 is the threshold current or higher, and the output voltage V3 is the threshold voltage or lower, in other words, in a case where the voltage V4 is the voltage Vth1 or higher, and the voltage V5 is the voltage Vth2 or lower, the abnormality determining unit 4*f* determines that an abnormality of the load has occurred. On the other hand, in a case where the voltage V4 is lower than the voltage Vth1, or the voltage V5 exceeds the voltage Vth2, the abnormality determining unit 4*f* determines that no abnormality is present.

In a case where the load forms a short circuit, the load impedance is markedly decreased to be lower than that of a normal time, and accordingly, an electric potential difference generated between the output terminals of the DC/DC converter 1 is markedly decreased to be lower than that of the normal time, so that the output current I1 that is the threshold current or higher flows between the output terminals of the DC/AC inverter 2. In this case, the voltage V4 measured by the measurement unit 3 is the voltage Vth1 or higher, and the voltage V5 measured by the measurement unit 3 is the voltage Vth2 or lower. Accordingly, since the voltage V4 is the voltage Vth1 or higher and the voltage V5 is the voltage Vth2 or lower at time t13 during the determination period t12, the control unit 4 determines that the load forms a short circuit and does not continue the startup operation but stops the voltage boosting operation of the DC/DC converter 1 (time t13). Here, since the DC/DC converter 1 is configured by a converter circuit that is of the non-insulating type, also after the operation of the DC/DC converter 1 is stopped at the time t13, current continuously flows through the high-pressure discharge lamp LP1. Thus, at time t20 when a predetermined time t19 elapses after the stop of the operation of the DC/DC converter 1, all of the four switching elements Q2 to Q5 configuring the DC/AC inverter 2 are turned off by the control unit 4 by setting the signal levels of both the signals LF1 and LF2 to the low level L. Accordingly, also in a case where the DC/DC converter 1 is of the non-insulating type, the current does not continuously flow through the high-pressure discharge lamp LP1 that is the load, and, in a case where the load forms a short circuit, a short current can be stopped from continuously flowing through the circuit.

In addition, as illustrated in FIGS. 13A to 13I, in a case where the load is determined to forma short circuit, the control unit 4, first, may turn off all of the four switching elements Q2 to Q5 configuring the DC/AC inverter 2 at time t13 and then stop the operation of the DC/DC converter 1 at time t20. Also in such a case, since the short current can be stopped from continuously flowing through the circuit, a time during which the short current flows in the circuit can be shortened to be less than that of the protection operation illustrated in FIGS. 12A to 12I, and accordingly, stress to be applied to the circuit can be further decreased.

On the other hand, in a case where the load is normal, during the determination period t12 described above, the voltage V4 measured by the measurement unit 3 is lower than the voltage Vth1, and the voltage V5 is higher than the voltage Vth2.

Thus, since the voltage V4 is lower than the voltage Vth1, or the voltage V5 is higher than the voltage Vth2, the control unit 4 determines absence of an abnormality, continues the startup operation, and starts and lights the high-pressure discharge lamp LP1.

As above, also in a case where the DC/DC converter 1 is of the non-insulating type, the load abnormality determination described in Embodiments 1 and 2 is performed, and, in a case where the load is determined to be abnormal, the operations of the DC/DC converter 1 and the DC/AC inverter 2 are stopped, so that an overcurrent flowing through the circuit can be suppressed.

In addition, the control unit 4 may determine the presence/absence of an abnormality in the load based on one of the output voltage and the output current measured by the measurement unit 3, and an abnormality of the load can be detected by employing a relatively simple circuit configuration for comparing the output voltage or the output current with the threshold.

As in the discharge lamp lighting device according to this embodiment described above, it is preferable that the DC/DC converter 1 is of the non-insulating type.

(Embodiment 4)

An embodiment in which the discharge lamp lighting device

Figure 14:
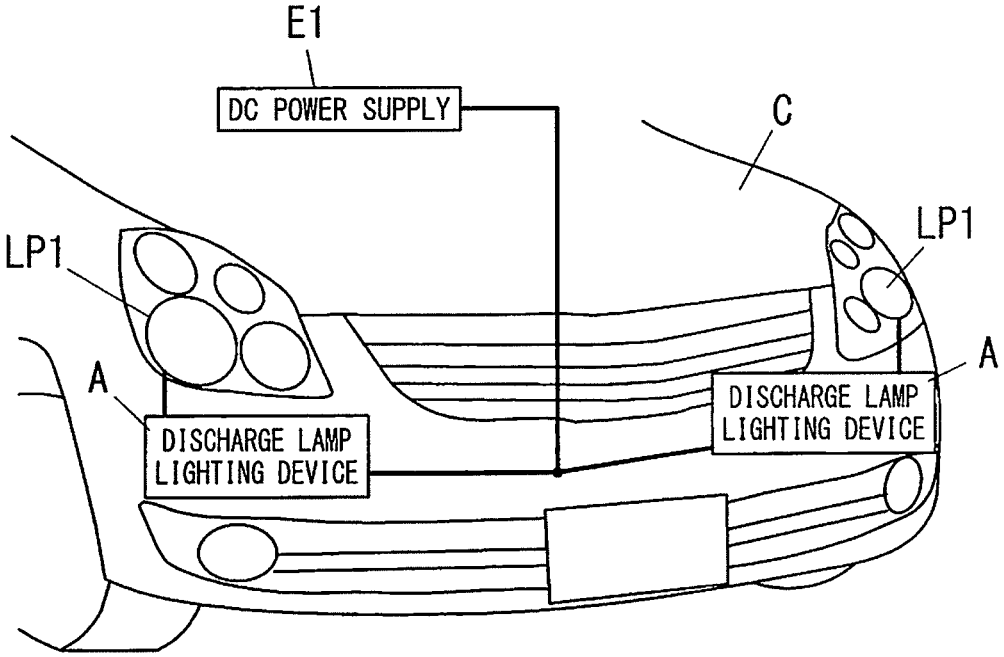
FIG. 14 is a diagram that schematically illustrates a vehicle in which a headlight according to Embodiment 4 is mounted.

A described in one of Embodiments 1 to 3 is applied to a headlight of a vehicle will be described with reference to FIG. 14. In other words, the headlight according to this embodiment includes the discharge lamp lighting device A.

The vehicle C includes the high-pressure discharge lamps LP1 as left and right headlights. In addition, the vehicle C includes the discharge lamp lighting devices A that light the high-pressure discharge lamps LP1 by using the DC power supply E1 as a power source. Here, the headlight is configured by the high-pressure discharge lamp LP1 and the discharge lamp lighting device A.

The discharge lamp lighting device A is one of the discharge lamp lighting devices described in Embodiments 1 to 3, and, in a case where an abnormality of the load including the high-pressure discharge lamp LP1 is detected, the discharge lamp lighting device stops the operations of the DC/DC converter 1 and the DC/AC inverter 2, so that an overcurrent is suppressed from flowing through the circuit.

In recent years, in vehicles, the weight and the size are decreased for the improvement of fuel efficiency, and the residential space inside the vehicles is requested to be increased for improving the comfort. As a result, the engine room tends to be small.

Thus, the temperature of the inside of the engine room becomes high, and a distance between the engine having a high temperature and the discharge lamp lighting device A lighting the headlights becomes narrow, and accordingly, the discharge lamp lighting device A is used in the environment of a higher temperature.

In a case where an abnormality of the load is detected at the time of starting up the high-pressure discharge lamp LP1, the discharge lamp lighting device A included in the headlight according to this embodiment stops the operations of the DC/DC converter 1 and the DC/AC inverter 2. Accordingly, an overcurrent can be suppressed from flowing through the circuit, and heat stress to be applied to the circuit components can be decreased. Thus, a headlight including the discharge lamp lighting device A having high robustness also in the case of being used under a high-temperature environment can be realized.

The invention claimed is:

1. A discharge lamp lighting device comprising:

a DC/DC converter configured to convert an input voltage input from a DC power supply into a voltage value that is necessary for lighting a discharge lamp by performing switching;

a DC/AC inverter configured by a bridge circuit in which at least one series circuit of a first switching element disposed on a high potential side and a second switching element disposed on a low potential side is connected between output terminals of the DC/DC converter, and configured to convert a DC output of the DC/DC converter into an AC output and supply the AC output to a load including the discharge lamp;

a drive unit configured to convert the DC output of the DC/DC converter into an AC output acquired by alternating polarity of the DC output at a predetermined period by alternately turning on the first switching element and the second switching element at the predetermined period at least at a time of stable lighting;

a measurement unit configured to measure at least one of an output voltage and an output current for the load; and a control unit configured to, when a measured value acquired by the measurement unit is in an abnormal range, decrease power to be supplied to the discharge lamp to be lower than power to be supplied to the discharge lamp at a normal time, wherein the drive unit includes a capacitor that supplies, to a control electrode of the first switching element disposed on the high potential side, electric charge necessary for turning on the first switching element when the second switching element disposed on the low potential side is turned off, the capacitor is charged when the second switching element is turned on, and when the discharge lamp is started up, the capacitor is started to be charged before the DC/DC converter starts to be operated, and the control unit has a determination period for determining presence/absence of an abnormality based on the measured value acquired by the measurement unit in a state in which the DC/DC converter and the DC/AC inverter are operated after completion of the charging of the capacitor.

2. The discharge lamp lighting device according to claim 1, wherein, when the measured value acquired by the measurement unit is in the abnormal range during the determination period, the control unit is configured to stop a switching operation of the DC/DC converter.

3. The discharge lamp lighting device according to claim 1, wherein the control unit is configured to detect formation of a short circuit in the load as the abnormality based on the measured value acquired by the measurement unit during the determination period.

4. The discharge lamp lighting device according to claim 1, wherein the drive unit is configured to charge the capacitor again in a case where the control unit determines that no abnormality is present during the determination period.

5. The discharge lamp lighting device according to claim 1, wherein the measurement unit is configured to measure an output current of the DC/DC converter during the determination period, and the control unit is configured to determine that formation of a short circuit has occurred in the load when a current value measured by the measurement unit is a predetermined threshold current or more.

6. The discharge lamp lighting device according to claim 1, wherein the measurement unit is configured to measure an output voltage of the DC/DC converter during the determination period, and the control unit is configured to determine that formation of a short circuit has occurred in the load when a voltage value measured by the measurement unit is a predetermined threshold voltage or less.

7. The discharge lamp lighting device according to claim 1, wherein the measurement unit is configured to measure both an output current and an output voltage of the DC/DC converter during the determination period, and the control unit is configured to determine that formation of a short circuit has occurred in the load when a current value measured by the measurement unit is a predetermined threshold current or more, and a voltage value measured by the measurement unit is a predetermined threshold voltage or less.

8. The discharge lamp lighting device according to claim 1, wherein, when determining that the abnormality has occurred during the determination period, the control unit is configured to turn off the first switching element disposed on the high potential side within a predetermined time.

9. The discharge lamp lighting device according to claim 1, wherein the DC/DC converter is of a non-insulating type.

10. A headlight comprising the discharge lamp lighting device according to claim 1.

11. The discharge lamp lighting device according to claim 2, wherein the control unit is configured to detect formation of a short circuit in the load as the abnormality based on the measured value acquired by the measurement unit during the determination period.

12. The discharge lamp lighting device according to claim 2, wherein the drive unit is configured to charge the capacitor again in a case where the control unit determines that no abnormality is present during the determination period.

13. The discharge lamp lighting device according to claim 3, wherein the drive unit is configured to charge the capacitor again in a case where the control unit determines that no abnormality is present during the determination period.

14. The discharge lamp lighting device according to claim 11, wherein the drive unit is configured to charge the capacitor again in a case where the control unit determines that no abnormality is present during the determination period.

* * * * *